US006947690B2

(12) United States Patent
Tazawa et al.

(10) Patent No.: US 6,947,690 B2
(45) Date of Patent: Sep. 20, 2005

(54) DEVELOPER SUPPLY CONTAINER

(75) Inventors: Fumio Tazawa, Abiko (JP); Masami Maetani, Ageo (JP); Yusuke Yamada, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 144 days.

(21) Appl. No.: 10/682,021

(22) Filed: Oct. 10, 2003

(65) Prior Publication Data

US 2004/0131389 A1 Jul. 8, 2004

(30) Foreign Application Priority Data

Oct. 16, 2002 (JP) ..... 2002-301431

(51) Int. Cl.[7] ..... G03G 15/08

(52) U.S. Cl. ..... 399/258; 222/DIG. 1; 399/262

(58) Field of Search ..... 399/222, 258, 399/260, 262, 263; 222/DIG. 1

(56) References Cited

U.S. PATENT DOCUMENTS

| | | | | |
|---|---|---|---|---|
| 4,212,264 A | | 7/1980 | Knechtel et al. | 118/653 |
| 5,296,900 A | | 3/1994 | Saijo et al. | 355/260 |
| 5,975,286 A | | 11/1999 | Oliff | 399/106 |
| 6,091,912 A | | 7/2000 | Kitajima et al. | 399/13 |
| 6,185,401 B1 | * | 2/2001 | Kanamori et al. | 399/262 |
| 6,292,644 B1 | | 9/2001 | Goto et al. | 399/262 |
| 6,314,261 B1 | | 11/2001 | Omata et al. | 399/258 |
| 6,438,345 B1 | | 8/2002 | Ban et al. | 399/262 |
| 6,731,897 B2 | * | 5/2004 | Nagano et al. | 399/262 |
| 6,766,133 B1 | * | 7/2004 | Ban et al. | 399/258 |
| 2002/0122676 A1 | | 9/2002 | Yamada et al. | 399/263 |
| 2002/0127029 A1 | | 9/2002 | Yamada et al. | 399/106 |

FOREIGN PATENT DOCUMENTS

| | | |
|---|---|---|
| DE | 40 17 458 A1 | 12/1990 |
| EP | 0 779 561 A1 | 6/1997 |
| JP | 7-44000 | 2/1995 |
| JP | 7-168430 | 7/1995 |
| JP | 9-120205 | 5/1997 |

* cited by examiner

*Primary Examiner*—Hoan Tran
(74) *Attorney, Agent, or Firm*—Fitzpatrick, Cella, Harper & Scinto

(57) ABSTRACT

A developer supply container detachably mountable to a developer supply apparatus including a container body, for accommodating developer, including a discharge opening for permitting discharge of the developer therefrom, coupling device, disposed connectable to a coupling member of the developer supply apparatus, for rotating the container body, feeding device for feeding the developer toward the discharge opening in the container body by the rotation of the container body, and regulation device, disposed at a peripheral surface of the container body, for regulating mounting of the developer supply container on the basis of whether or not it is substantially fitted with a regulation member of the developer supply apparatus. After the developer supply container is set to the developer supply apparatus, the regulation device is capable of rotating the regulation member of the developer supply apparatus by a rotational force received by the coupling device while retaining engagement of the regulation device with the regulation member.

5 Claims, 23 Drawing Sheets

DEVELOPER SUPPLY CONTAINER

FIELD OF THE INVENTION AND RELATED ART

The present invention relates to a developer supply container for supplying developer to a developer supply apparatus such as a copying machine, a printer, a facsimile machine, or the like.

In a conventional electrophotographic image forming apparatus such as an electrophotographic copying machine or a printer, fine particles developer is used. When the developer in the main assembly of the electrophotographic image forming apparatus is used up, the developer is supplied into the main assembly of the image forming apparatus using a developer supply container. In recent years, commonality of the image forming apparatus main assembly and the developer supply container is intended to be achieved among various models in order to reduce costs. However, if the commonality is completely achieved, there arises such a difficulty that a developer supply container accommodating developer different in color or kind from an original one is erroneously mounted.

For this reason, in order to prevent the erroneous mounting of the developer supply container accommodating the different developer to the image forming apparatus main assembly, such a measure that non-interchangeability between the developer supply container and the developer supply container accommodating the different developer is ensured by employing a combination of a projection portion provided at the image forming apparatus main assembly and a recess portion provided at the developer supply container is taken.

However, in recent years, there has been adopted such a developer supply scheme that developer is discharged from a small opening little by little in a state that the developer supply container is disposed within the main assembly of the image forming apparatus so as not to cause scattering of developer due to very fine particles of developer at the time of developer supply operation. Such a developer supply scheme is, e.g., described in Japanese Laid-Open Patent Application (JP-A) No. Hei 07-44000, wherein the developer supply container has an almost cylindrical bottle shape and is mounted and used in the image forming apparatus main assembly so that developer is fed and discharged by exerting a driving force from the apparatus main assembly side on the container body to rotate the container body per se.

Accordingly, in the case of using the developer supply container, for use in such a developer supply scheme, which cannot be replaced with a different developer supply container, when the method described above employing a simple combination of projection and recess portions (e.g., as described in JP-A Hei 09-120205) is adopted, the developer supply container is rotated relative to the image forming apparatus main assembly after being mounted to the image forming apparatus main assembly, so that the method imposes again positional alignment for permitting an appropriate positional relationship between the projection and recess portions as an improper interchange-preventing means on a user at the time of mounting or demounting the developer supply container, thus causing a lowering in operability. Further, in the case where the user mounts or demounts the developer supply container in order to prevent the lowering in operability, it can be considered that means or mechanism for controlling a rotation stop position of the developer supply container so as to establish the appropriate positional relationship between the projection and recess portions as the improper interchange-preventing means is disposed on the main assembly side of the image forming apparatus. However, such a means or mechanism leads to complication of the image forming apparatus main assembly and increase in cost, thus being less-than-decisive means.

Further, as a proposal for solving the problems, such a scheme that the non-interchangeability of the developer supply container is ensured by changing the arrangement of a projection for permitting transmission of a driving force at a leading surface of the developer supply container (by changing the projection arrangement in a radial direction of the container) as described in JP-A Hei 07-168430 is also proposed. However, according to this scheme, an improper interchange-preventing projection is provided at the leading surface of the developer supply container, so that a user (operator) fails to perform the positional alignment of the projection at the time of mounting the developer supply container while visually checking a state thereof. Further, when the user tries mounting of a developer supply container accommodating an improper developer in terms of color to the image forming apparatus main assembly, it is impossible to make the user readily aware of the improper developer. Accordingly, the scheme is also not an unfailing method in terms of operability.

Further, the scheme, the projection for preventing the improper interchange also functions as means for transmitting a driving force to the container body, so that there is a possibility that the driving force transmission cannot be made due to, e.g., breakage of the projection by drop impact or improper operation by the user. Further, the arrangement of the projection in its radial direction is changed, so that the projection is located closer to a rotation axis of the developer supply container in some cases. In such cases, an excessive load is exerted on the projection, so that it is necessary to make the projection rugged to the extent that it has a certain strength. As a result, the scheme is also not preferable in terms of flexibility is cost and design.

SUMMARY OF THE INVENTION

An object of the present invention is to provide a developer supply container capable of readily performing mounting and demounting thereof with reliability.

According to the present invention, there is provided a developer supply container detachably mountable to a developer supply apparatus, comprising:

a container body, for accommodating developer, including a discharge opening for permitting discharge of the developer therefrom, coupling means, disposed connectable to a coupling member of the developer supply apparatus, for rotating the container body, feeding means for feeding the developer toward the discharge opening in the container body by the rotation of the container body, and regulation means, disposed at a peripheral surface of the container body, for regulating mounting of the developer supply container on the basis of whether or not it is substantially fitted with a regulation member of the developer supply apparatus, wherein after the developer supply container is set to the developer supply apparatus, the regulation means is capable of rotating the regulation member of the developer supply apparatus by a rotational force received by the coupling means while retaining engagement of the regulation means with the regulation member.

This and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be specifically described in conjunction with the accompanying drawings.

(Embodiment 1)

Figure 1:
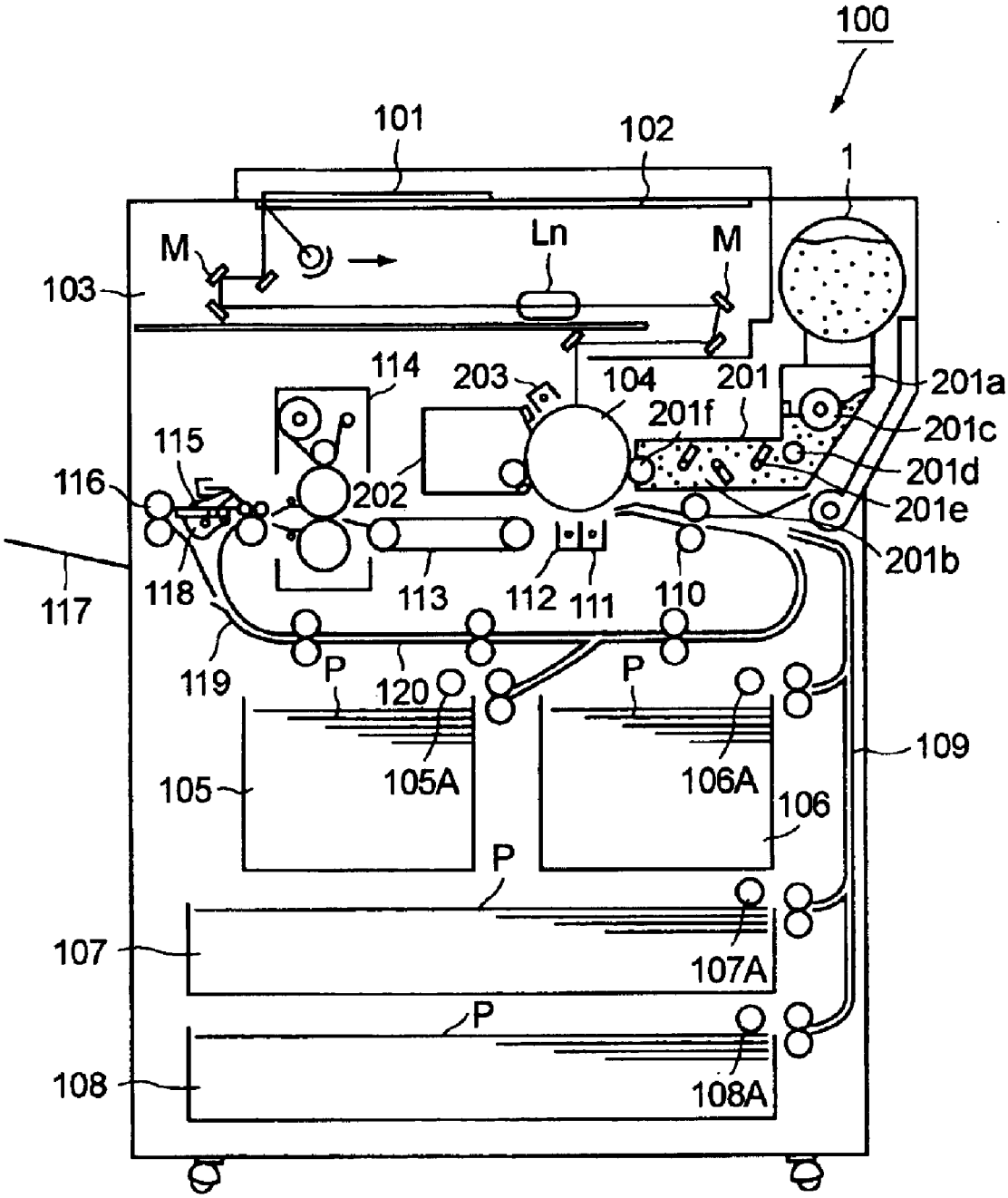
FIG. 1 is a sectional view of an image forming apparatus according to an embodiment of the present invention.

Referring to FIG. 1, the description will first be made as to an electrophotographic image forming apparatus which is an exemplary image forming apparatus including a developer supply container into which a developer supply container according to this embodiment of the present invention is mounted.

(Electrophotographic Image Forming Apparatus)

Figure 2:
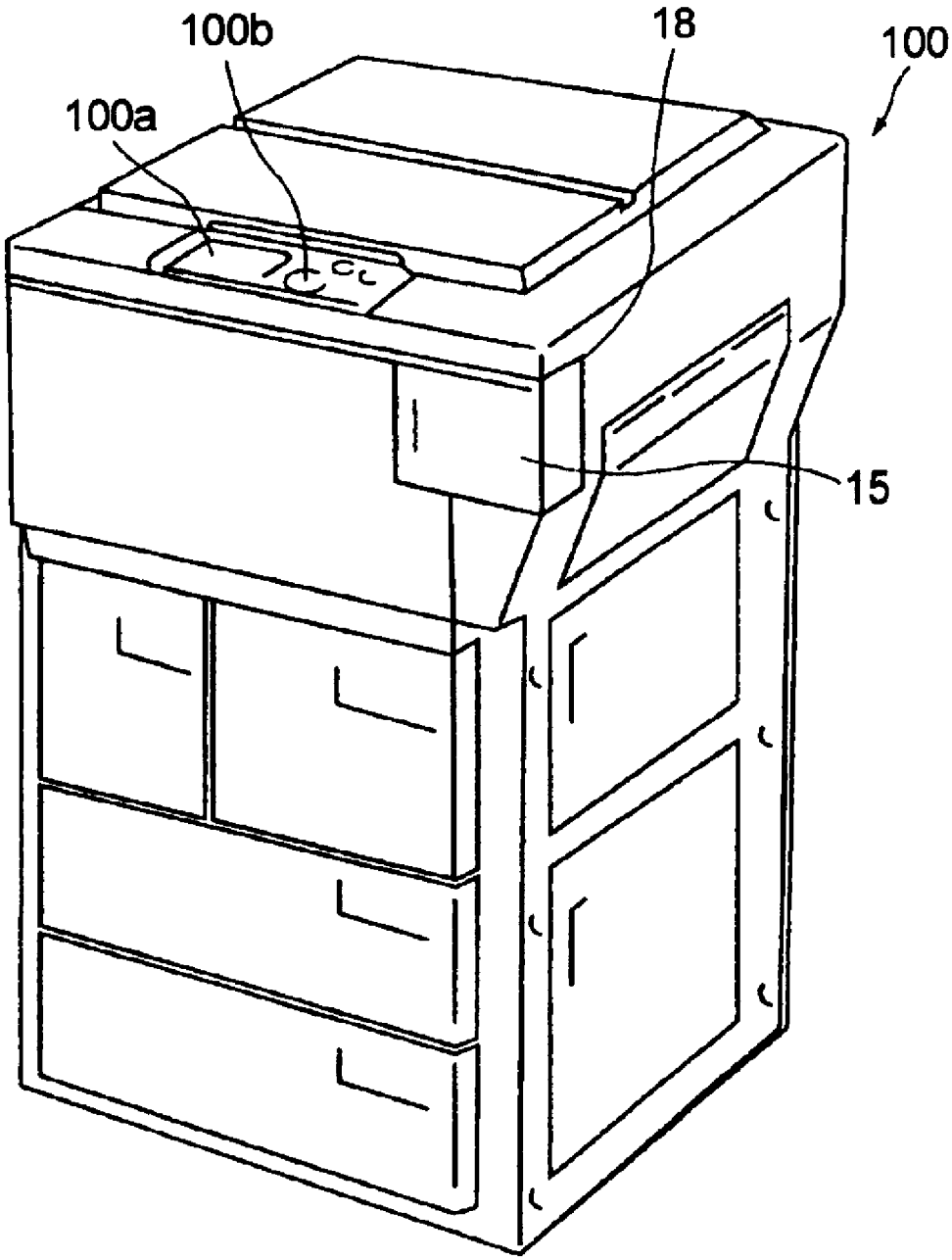
FIG. 2 is a perspective view of the image forming apparatus shown in FIG. 1.

FIG. 1 shows an electrophotographic copying machine. An original 101 in a main assembly (main assembly of apparatus) 100 is placed on an original supporting platen glass 102. A light image corresponding to the image information of the original 101 is imaged on an electrophotographic photosensitive drum (image bearing member) 104 through a plurality of mirrors M and a lens Ln of an optical portion 103. On the basis of selection by the user on an operating portion 100*a* shown in FIG. 2 or on the basis of automatic selection in accordance with the paper size of the original 101, an optimum sheet P is selected from the cassettes 105, 106, 107, 108. The recording material is not limited to the sheet of paper, but may be an OHP sheet, for example.

A single recording sheet P supplied from one of separating devices 105A, 106A, 107A, 108A, is fed to registration rollers 110 by way of a feeding portion 109, and the recording sheet P is fed to the transfer portion by the registration rollers 110 in synchronism with the rotation of the photosensitive drum 104 and the scanning timing of the optical portion 103. In the transfer portion, a developer image formed on the photosensitive drum 104 is transferred onto the recording sheet P by a transfer discharger 111. The recording sheet P now having the transferred toner image is separated from the photosensitive drum 104 by a separation discharger 112.

The sheet P is fed into a fixing portion 114 by a feeding portion 113. In the fixing portion 114, the toner image is fixed on the sheet P by heat and pressure. Thereafter, the sheet P is passed through a discharged sheet reversing portion 115 and discharged to a sheet discharge tray 117 by sheet discharging rollers 116 in the case of a one sided copy mode. In the case of a duplex copy mode, the sheet P is refed to the registration rollers 110 through sheet refeeding paths 119, 120, under the control of a flapper 118 provided in the discharged sheet reversing portion 115. Then, the sheet is fed similarly to the case of the one-sided copy mode, and is finally discharged to the sheet P discharge tray 117.

In the case of a superimposed copy mode, the sheet P is temporarily and partly discharged by the sheet discharging rollers 116 through the discharged sheet reversing portion 115. Thereafter, at the timing when the trailing edge of the sheet passes by the flapper 118 while it is still nipped by the sheet discharging rollers 116, the flapper 118 is controlled, and the sheet discharging roller 116 is rotated in the reverse direction, so that it is refed into the main assembly 100. Thereafter, the sheet P is fed to the registration rollers 110 through the sheet refeeding portions 119, 120, and then the sheet P is processed similarly to the case of the one-sided copy mode. It is finally discharged to the sheet discharge tray 117.

In the main assembly 100 of apparatus, there are provided a developing device 201, a cleaning device 202, the primary charger 203 and so on, around the photosensitive drum 104.

An electrostatic latent image is formed by exposing the photosensitive drum 104 to the image light corresponding to the image information of the original 101 by the optical portion 103. The electrostatic latent image is developed with developer by a developing device 201. In order to supply the developer into the developing device 201, a developer supply container 1 is detachably mountable by the user into the main assembly 100 of apparatus.

The developing device 201 comprises a developer hopper 201*a* and a developing device 201*b*. The developer hopper 201*a* is provided with a stirring member 201*c* for stirring the developer supply designated from the developer supply container 1. The developer stirred by the stirring member 201*c* is supplied into the developing device 201*b* by a magnet roller 201*d*. The developing device 201*b* comprises a developing roller 201*f* and a feeding member 201*e*. The developer fed from the developer hopper 201*a* by the magnet roller 201*d* is fed to the developing roller 201*f* by the feeding member 201*e*, and it supplied to the photosensitive drum 104 by the developing roller 201*f*.

The cleaning portion 202 functions to remove the developer remaining on the photosensitive drum 104. The primary charger 203 functions to electrically charge the photosensitive drum 104.

(Developer Supply Apparatus>

Figure 3:
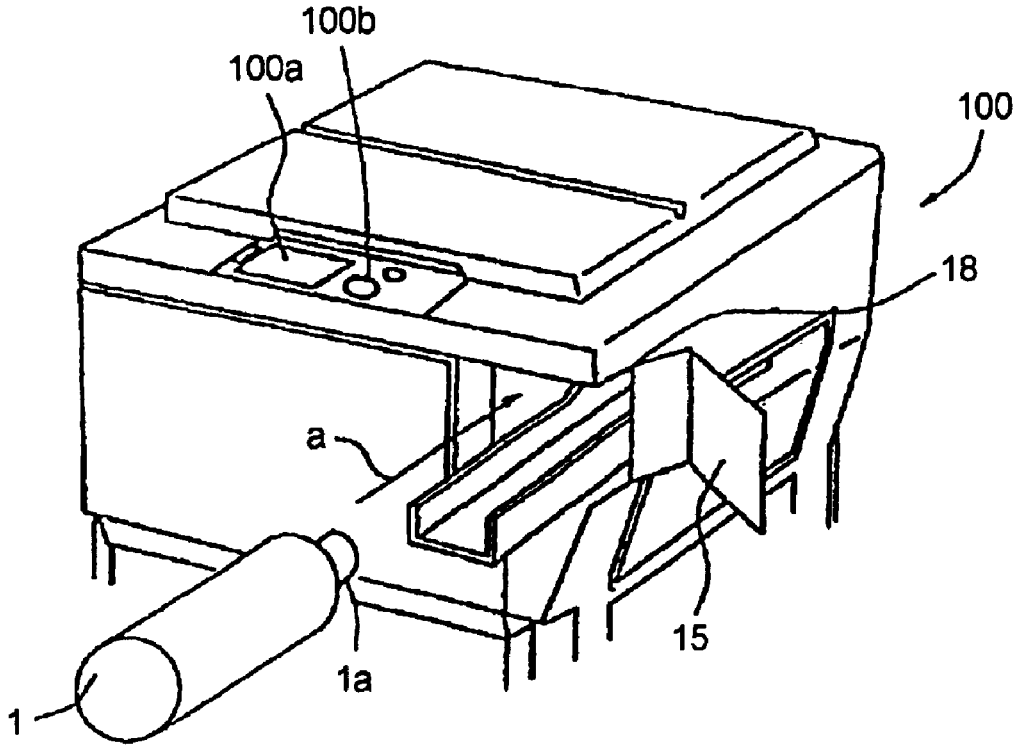
FIG. 3 is a perspective view illustrating mounting of the developer supply container according to the present invention into a main assembly of an image forming apparatus.

The developer supply apparatus will be described below in detail with reference to the drawings. As shown in FIG. 3, when the user opens a front cover 15 for exchange of the developer supply container (front cover) which is a part of an outer casing shown in FIG. 2, a developer supply apparatus 400 (as show in FIG. 4) is made accessible to the user. A developer supply container 1 described specifically later is demounted from and mounted to the developer supply apparatus 400, whereby the developer is supplied to the main assembly of the image forming apparatus.

Figure 4:
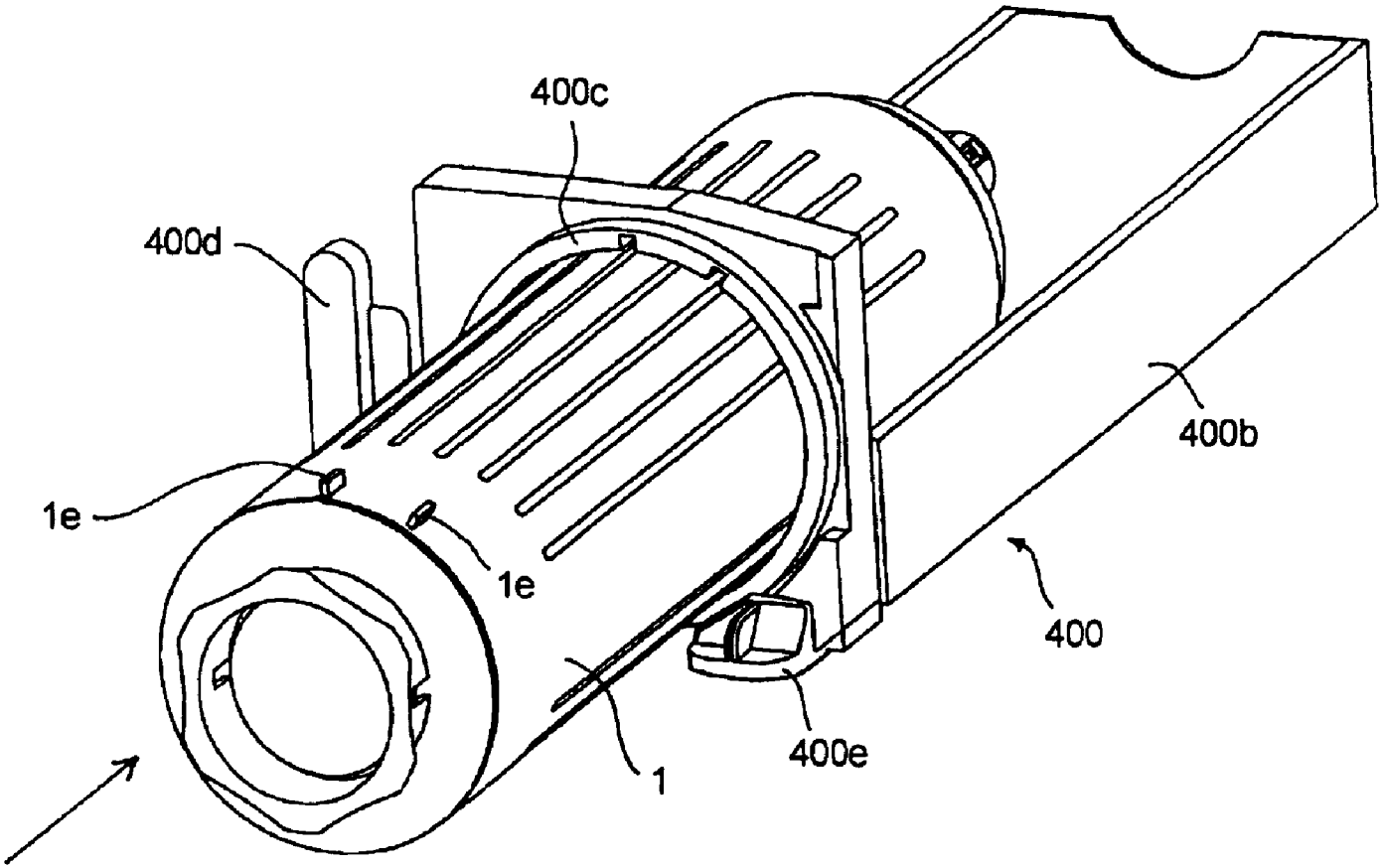
FIG. 4 is an enlarged perspective view illustrating mounting of the developer supply container into a developer supply apparatus.
Figure 5:
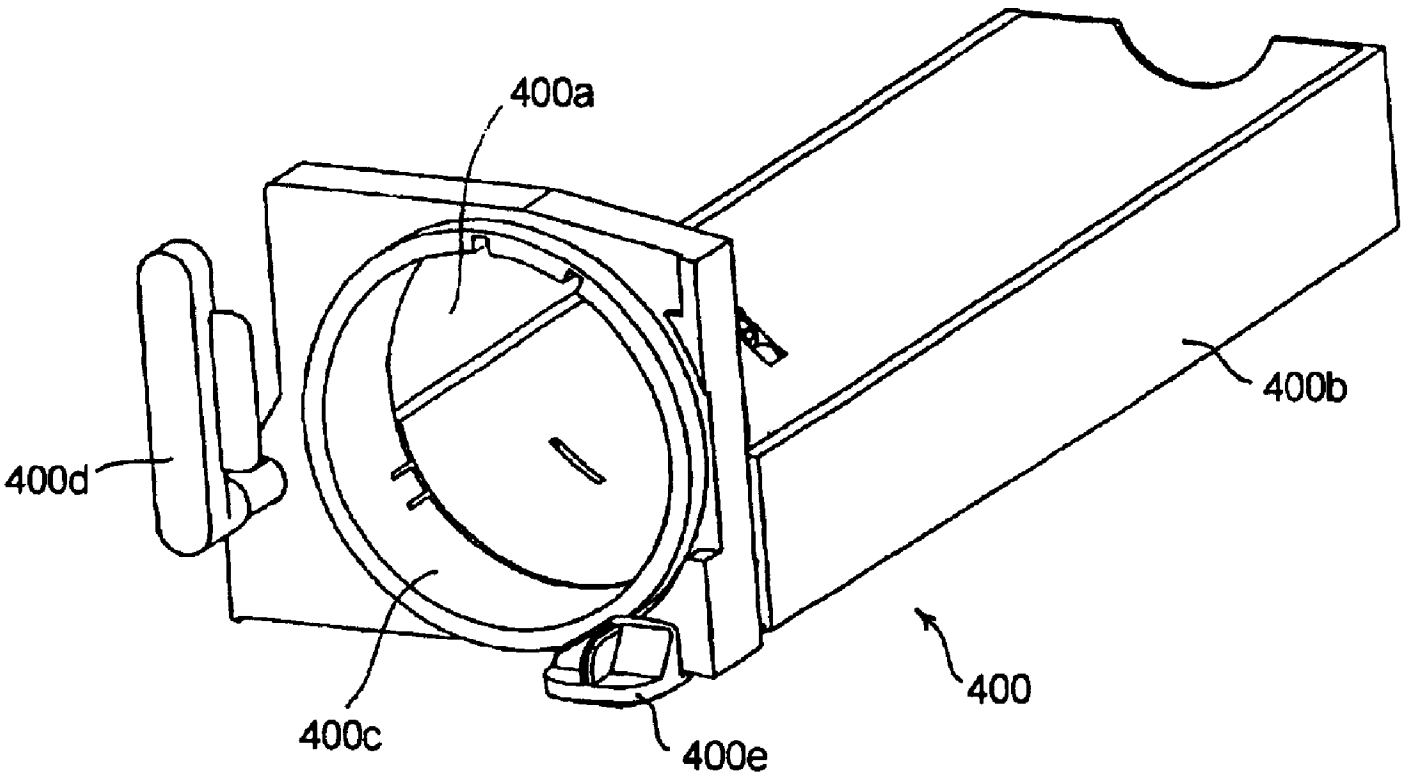
FIG. 5 is a perspective view of the developer supply apparatus.
Figure 6:
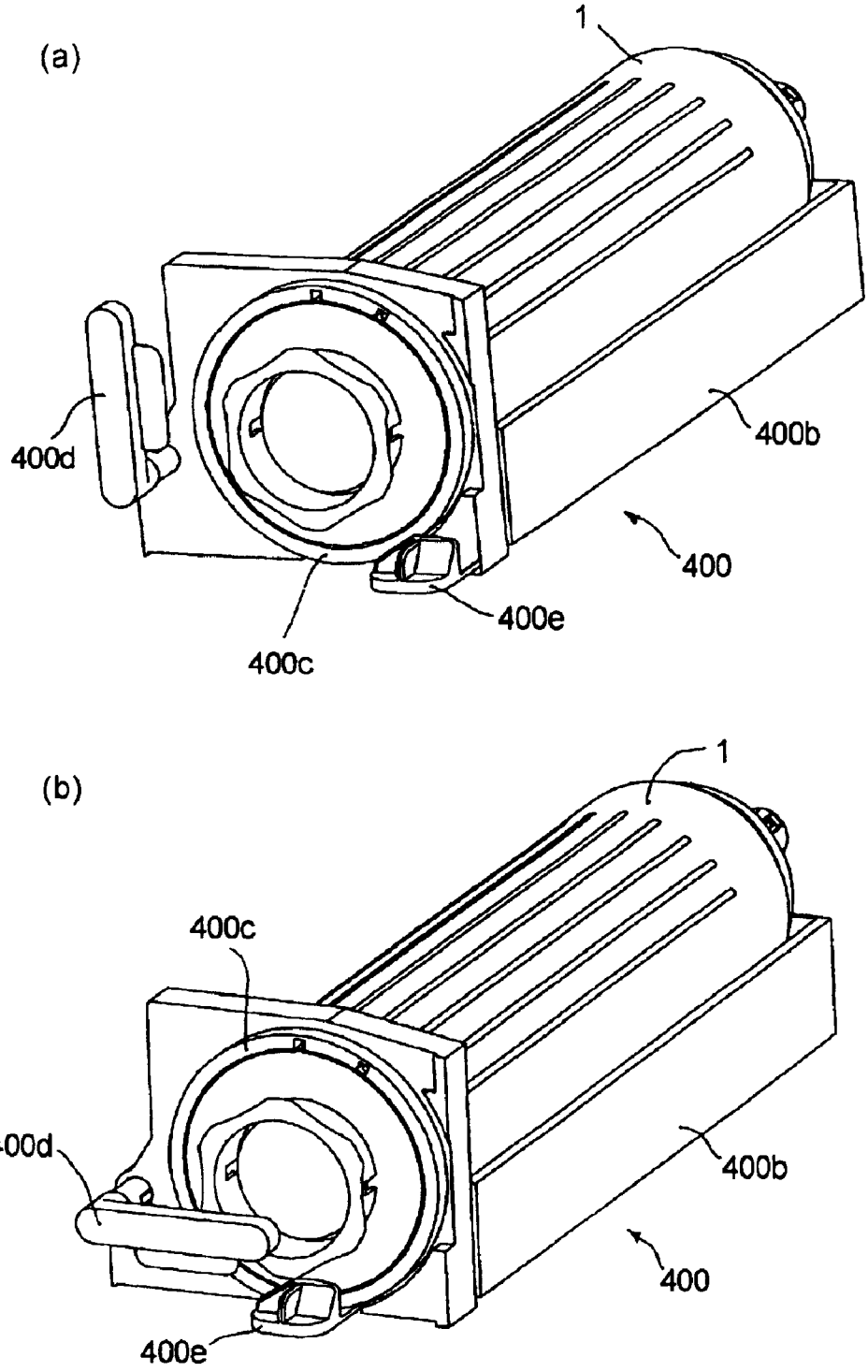
FIGS. 6(*a*) and 6(*b*) are perspective views illustrating a mounted state of the developer supply container into the developer supply container into the developer supply apparatus, wherein FIG. 6(*a*) shows state before a rotation lever and a developer supply container fixing member are operated, and FIG. 6(*b*) shows a state after the completion of operation of the rotation lever and the fixing member (the completion of insertion).

The structure of the developer supply apparatus will be described in detail with reference to FIGS. 4–6. FIG. 4 is a perspective view showing a state in the process of mounting operation of the developer supply container 1 into the developer supply apparatus 400 to be mounted in the image forming apparatus main assembly 100. FIG. 5 is a perspective view of the developer supply apparatus 400 alone. FIG. 6 illustrates a state of the developer supply container 1 into the developer supply apparatus 400, wherein (a) shows a state before a rotating lever 400*d* and a developer supply container fixing member ar operated, and (b) shows a state after the completion of operation of the rotation lever and the developer supply container fixing member (the completion or insertion (mounting)). As shown in FIGS. 4–6, the developer supply apparatus 400 includes a developer supply container receiving opening 400*a* as an opening for receiving the developer supply container 1 to be mounted, a developer supply container receiving cradle (mounting portion) 400*b* in which the mounted developer supply container 1 is set, a mounting control member 400*c* disposed rotatable relative to the developer supply apparatus 400 as a regulation member depending on the kind of developer used in the image forming apparatus main assembly 100, the rotation lever 400*d* for engaging and disengaging the developer supply container 1 with (or from) the developer supply apparatus 400 by turning it at the time of exchange thereof, and the developer supply container fixing member 400*e* for fixing the position of the developer supply container 1 mounted in the developer supply apparatus 400. Functions and actions of these members will be described specifically later in Exchanging method for developer supply container.

<Developer Supply Container>

Figure 7:
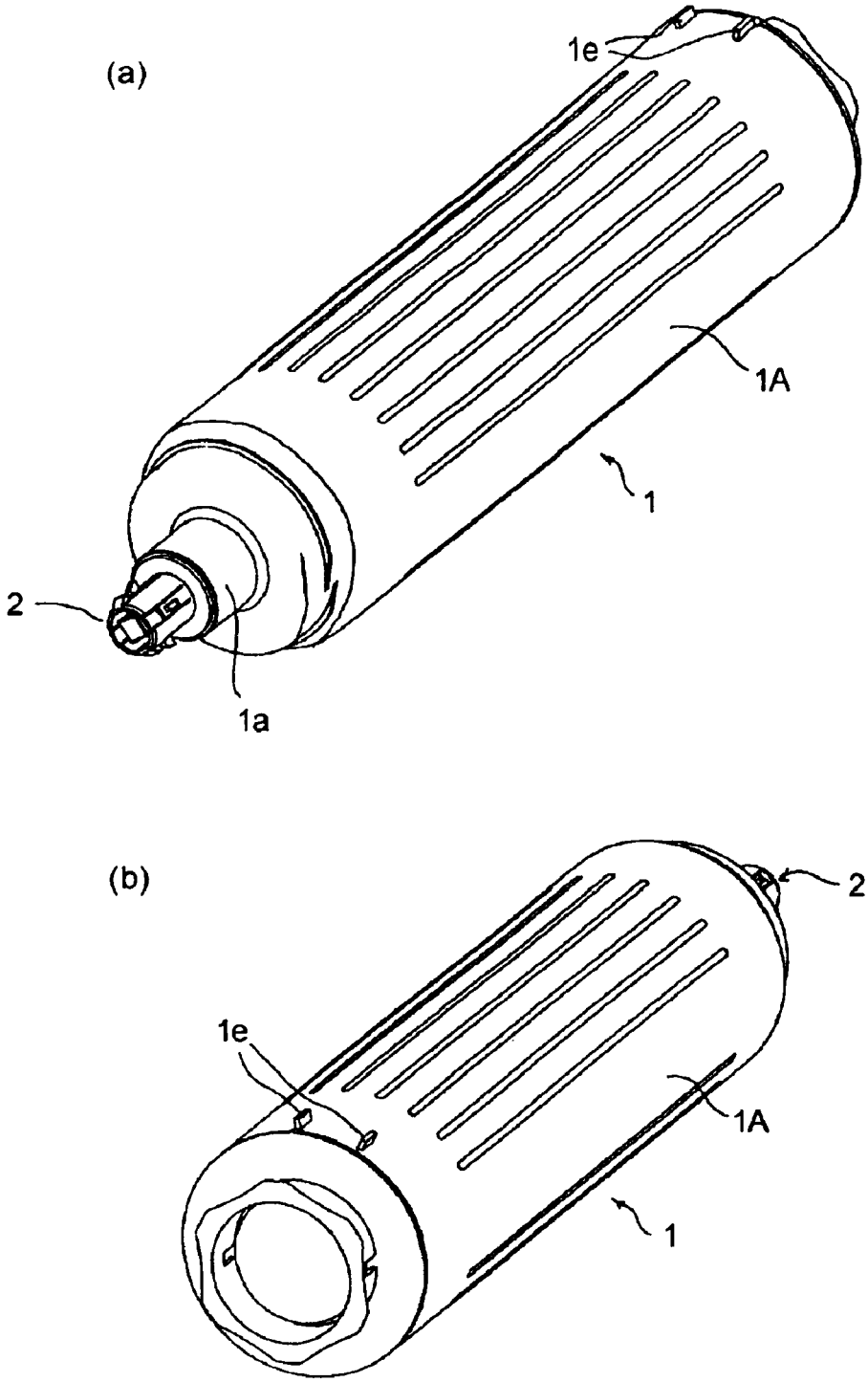
FIGS. 7(*a*) and 7(*b*) are perspective views of the developer supply container, wherein FIG. 7(*a*) is a perspective view viewed from its leading end side, and FIG. 7(*b*) is a perspective view viewed from its trailing end side.
Figure 8:
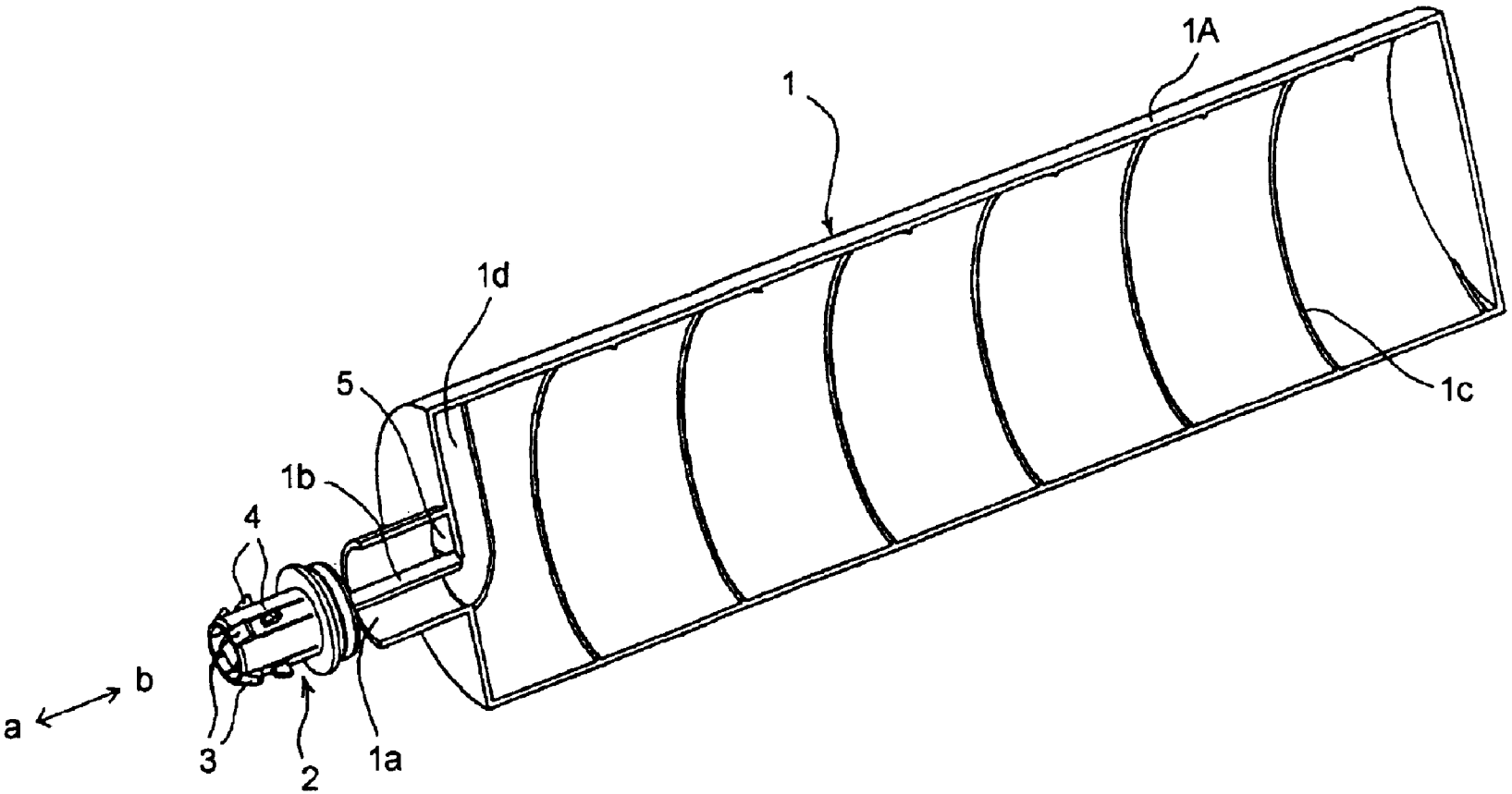
FIG. 8 is a partly broken perspective view of a developer supply container including a helical projection therein as a feeding/discharge means.
Figure 9:
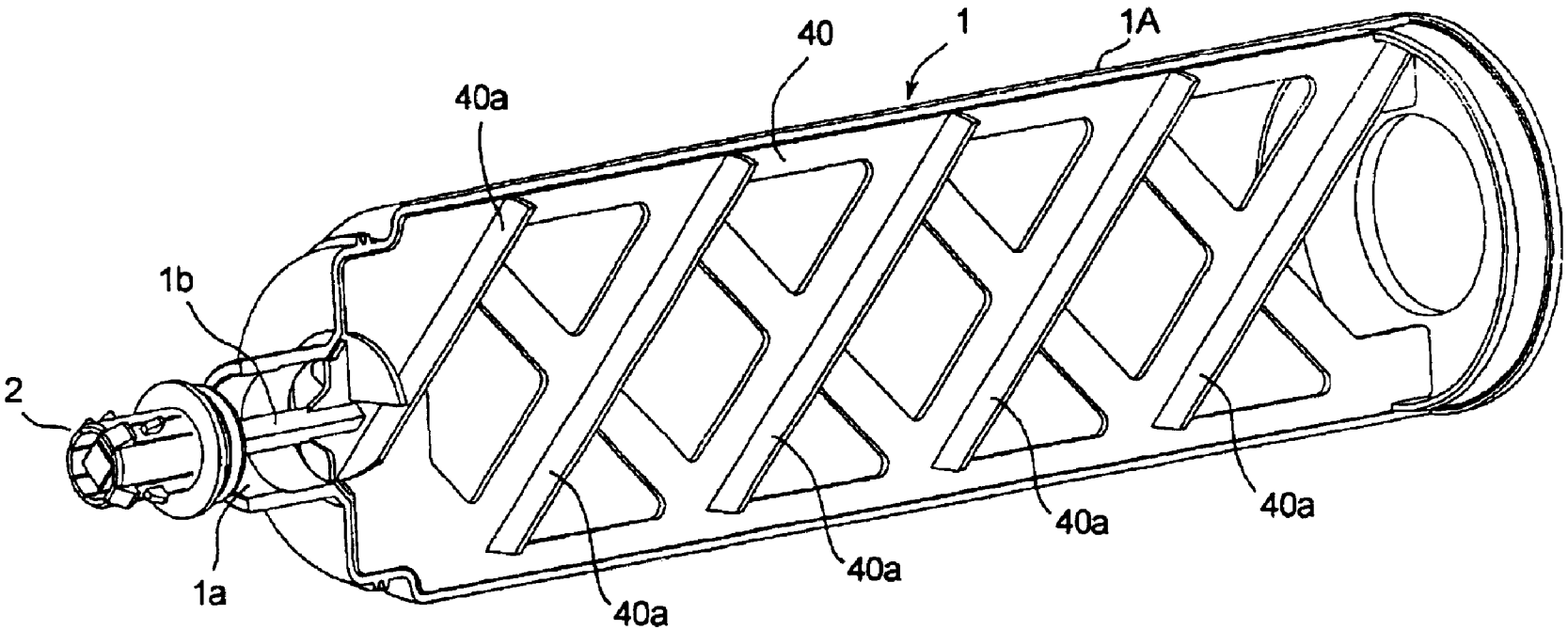
FIG. 9 is a partly broken perspective view of a developer supply container including a baffle member therein as the feeding/discharge means.

With reference to FIGS. 7–9, the developer supply container will be described below.

FIG. 7 is perspective views, wherein (a) is a perspective view of the developer supply container 1 viewed from an opening 1*a* side, and (b) is a perspective view of the developer supply container 1 viewed from an opposite side. FIG. 8 is a partly broken perspective view of the developer supply container 1 including therein a helical projection 1*c* as a feeding/discharge means. FIG. 9 is a partly broken perspective view of the developer supply container 1 including therein a buffle member 40 as the feeding/discharge means. The buffle member 40 includes a lifting portion for lifting the developer within the container by rotation, a guiding portion for guiding, by rotation, the developer lifted by the lifting portion in the downward direction toward the opening, and a drop portion for dropping, by rotation, the developer lifted by the lifting portion in the downward direction without feeding it toward the opening.

The developer supply container 1 is generally cylindrical, and one end thereof is provided substantially at a center with the opening 1*a* by a projected portion. The diameter of the opening 1*a* is smaller than the diameter of the cylindrical portion 1A which is the main body of the bottle (container). The opening 1*a* is plugged with a sealing member 2 for sealing the opening 1*a*, and as will be understood from the description in conjunction with FIGS. 7, (*a*) and (*b*), the opening 1*a* is unsealed and resealed automatically by the sliding motion of the sealing member 2 relative to the developer supply container 1 in the longitudinal (axial) direction (arrow a–b shown in FIG. 8) of the developer supply container. At the free end portion of the sealing member 2, there is formed a cylindrical portion having an engaging projection 3 as an elastically deformable coupling and a disengaging portion 4 (FIG. 12) for disengaging the engaging projection 3 from the driving portion 20 (FIG. 15) provided in the main assembly of apparatus.

The engaging projection 3 is engaged with the driving portion 20 as a coupling member and functions to transmit the rotation (driving force) to the developer supply container 1. The structures of the engaging projection 3 and the disengaging (releasing) portion 4 will be described in detail hereinafter.

The internal structure of the toner bottle 1 will be described.

As described in the foregoing, the developer supply container 1 is generally cylindrical in shape and is disposed generally horizontally in the main assembly 100 of apparatus. It is rotated by the main assembly 100 of apparatus. An inside of the developer supply container 1 has a helical projection 1*c*, as a feeding portion, in the form of a rib which extends helically as shown in FIG. 8. When the developer supply container 1 rotates, the developer is fed in the axial direction along the helical projection 1*c*, and the toner is discharged through the opening 1*a* formed at an end of the developer supply container 1.

As shown in FIG. 7, the developer supply container 1 is provided with mounting control portion as a regulation member at a trailing end side in the mounting direction of the developer supply container 1. In this embodiment, the mounting control portion comprises at least one mounting control projection 1*e* (projection portion) projected from an external surface of the main body of the developer supply container 1. By the combination mounting control projection 1*e* and a mounting control member 400*c* provided to the developer supply apparatus 400, only the developer supply container 1 accommodating the developer used in the image forming apparatus main assembly 100 is made mountable properly to the image forming apparatus main assembly 100. The details of the structure will be described in Exchanging method or developer supply container 1.

The internal structure of the developer supply container 1 according to the present invention is not limiting, and the configuration or the structure may be any as long as the developer can be discharged by rotation of the developer supply container 1.

The feature this embodiment is in the structure of the drive transmitting portion for connection of the developer supply container 1 for discharging the developer with the main assembly 100 of the apparatus by rotation, and therefore, the internal structure of the developer supply container 1 may be any, and the developer supply container 1 may have a helical projection 1*c* on the inner surface of the bottle.

For example, the internal structure of the developer supply container 1 may be modified as shown in FIG. 9. In this modified example, there is provided in the main body of the developer supply container (bottle) a buffle member 40, as a feeding portion, generally in the form of a plate. The surface of the buffle member 40 has, on a surface, a plurality of inclined projections 40*a* which are inclined with respect to the direction of the axis of the developer supply container 1. One end of one of the inclined projection 40*a* extends to a neighborhood of the opening 1*a*. The developer is finally discharged from the inclined projection 40*a* through the opening 1*a*. By the rotation of the developer supply container 1, the developer is scooped by the buffle member 40 and then falls sliding on the surface of the buffle member 40. Because of the inclination of the inclined projection 40*a*, the developer is advanced toward the front side of the developer supply container 1. By repeating this operation, the developer in the developer supply container 1 is gradually fed to the opening 1*a* while being stirred, and is discharged therethrough.

As described above, the cylindrical portion 1A of the main body of the developer supply container 1 is provided with the opening 1*a* at the one longitudinal end surface thereof, and a driving shaft 1*b* (portion to be engaged) is projected out of the opening 1*a*, the driving shaft 1*b* being integral with the buffle member 40 of the developer supply container and being provided in the opening 1*a*. The driving shaft 1*b* is disposed substantially coaxially with the opening 1*a*, and is (slidably) engaged with an engaging hole 2*a* (FIG. 12) formed in the sealing member 2.

The driving shaft 1*b* functions to transmit the rotational driving force from the main assembly 100 of the apparatus to the main body 1A of the developer supply container 1 through the sealing member 2, so that the cross-sectional configuration of the driving shaft 1*b* is, for example, rectangular configuration, H shape, D shape or the like to transmit the rotational driving force. The buffle member 40 is fixed on the main body 1A of the bottle by known proper means.

Figure 14:
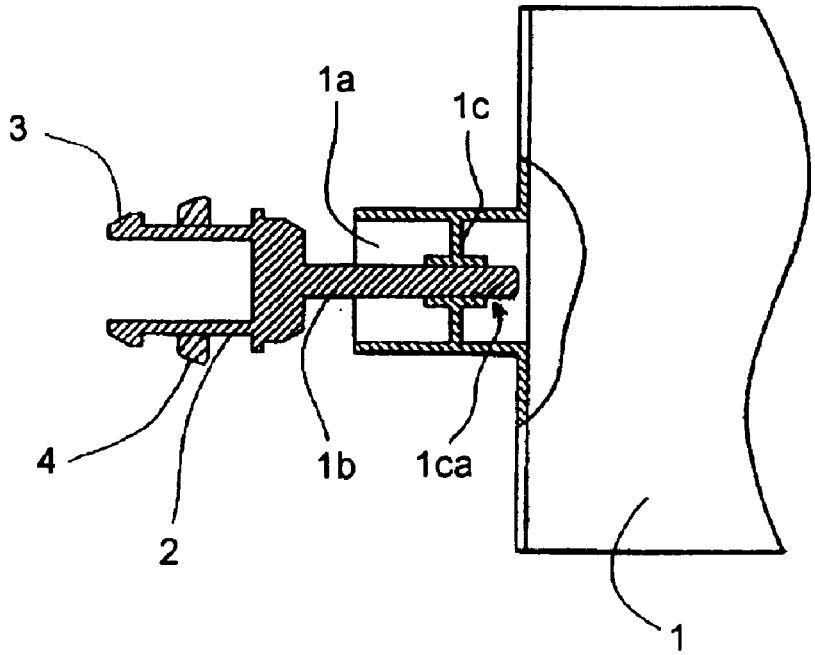
FIG. 14 is a partly enlarged section of view of a drive transmitting portion in which a driving shaft is provided on a sealing member side.

The driving shaft 1*b* may not be fixed on the buffle member 40 of the developer supply container 1 but is integral with the sealing member 2 as shown in FIG. 14. In this case, an engaging hole 1*ca* for transmitting the driving force from the driving shaft 1*b* is required to be provided in the developer supply container 1 side. In the modified example, a member 1*c* constituting the opening 1*a* its provided with the engaging hole 1*ca*.

<Sealing Member>

Figure 12:
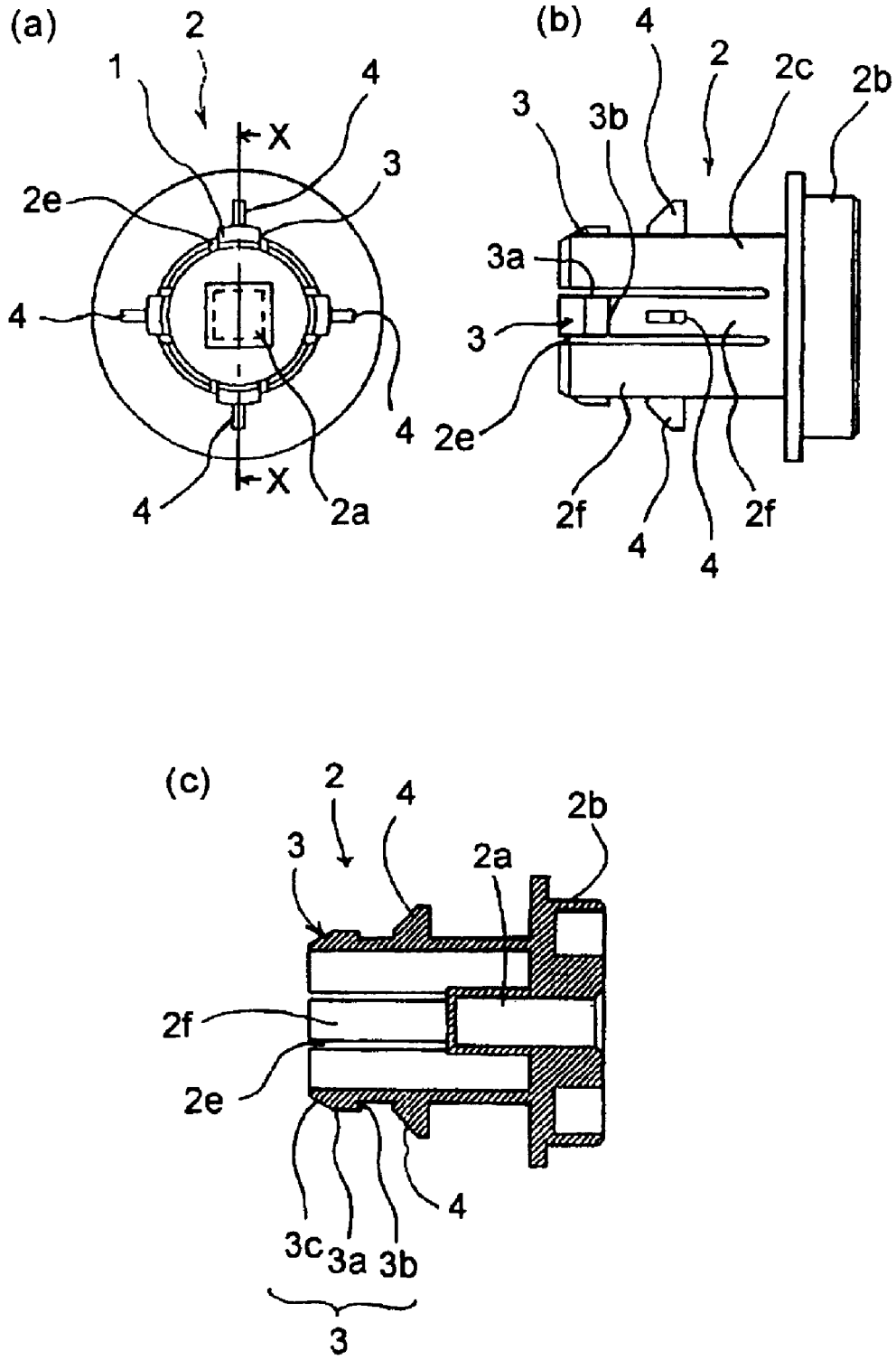
FIGS. 12(*a*), 12(*b*), and 12(*c*) are explanatory views of a sealing member, wherein FIG. 12(*a*) is a front view, FIG. 12(*b*) is a side view, and FIG. 12(*c*) is a sectional view.
Figure 13:
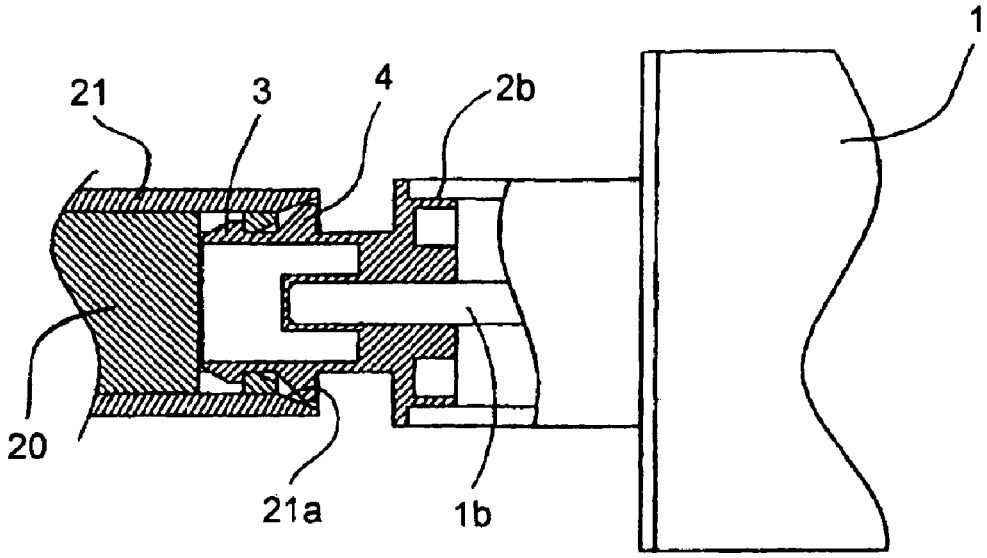
FIG. 13 is a sectional view illustrating engagement of the sealing member with a driving portion.

Referring to FIGS. 12 and 13, the description will be made as to the sealing member 2. FIG. 12 is views showing an embodiment of the sealing member 2 used in the developer supply container of the present invention wherein (a) is a front view, (b) is a side view, and (c) is a sectional view. FIG. 13 is a sectional view showing a state of engagement of the sealing member 2 with the driving shaft 1*b*.

In FIGS. 12 and 13, the sealing member 2 comprises a sealing portion 2*b* for unsealably sealing the opening 1*a* of the developer supply container 1, and a coupling engagement portion 2*c* (driving force receiving portion) in the form of a cylinder engageable with the driving portion 20 of the main assembly of apparatus. An outer diameter of a large diameter portion of the sealing portion 2*b* is larger than the inner diameter of the opening 1*a* by a proper degree. The sealing portion 2*b* is press-fitted into the opening 1*a*, by which the opening 1*a* (developer discharge opening) is sealed by the sealing member 2.

As described in the foregoing, the sealing member 2 has an engaging hole 2*a* for transmitting the driving force received from the main assembly 100 of the apparatus to the driving shaft 1*b* by engagement with the driving shaft 1*b*. The engaging hole 2*a* extended continuously in the sealing portion 2*b* and the engaging portion 2*c*. The engaging hole 2*a* has a polygonal configuration corresponding to that of the driving shaft 1*b*. In this embodiment, it is square. The engaging hole 2*a* has a cross-sectional configuration which is slightly larger than the cross-section of the driving shaft 1*b*. Because of this, the driving shaft 1*b* is loosely fitted in the engaging hole 2*a*.

Because of the loose fitting of the driving shaft 1*b* in the engaging hole 2*a* having such cross-sections, the cylindrical portion 1A of the developer supply container 1 and the sealing member 2 are movable relative to each other in the axial direction while being prevented from relative rotational motion therebetween. With this structure, when the developer supply container 1 is mounted (locked) on the developer supply apparatus 400, the sealing member 2 is movable relative to the main body 1A of the developer supply container, that is, the unsealing of the opening 1*a* (developer supply opening) is enabled.

The engagement length between the engaging hole 2*a* and the driving shaft 1*b* is determined such that they are not disengaged from each other upon the relative movement between the sealing member 2 and the main body 1A of the developer supply container for the unsealing. By doing so, the driving shaft 1*b* can receive the driving force through the sealing member 2 even if the sealing member 2 is moved away relatively from the developer supply container main body 1.

The description will be made specifically as to the engaging projection 3.

The coupling engagement portion 2*c* of the sealing member 2 has an engaging projection 3 for receiving the driving force from the main assembly 100 of apparatus. The engaging projection 3 is projected radially outwardly from the peripheral surface of the cylindrical portion of the coupling engagement portion 2*c*. The engaging projection comprises a drive receiving surface 3*a* (driving force receiving portion) for receiving the rotational driving force from the main assembly of the apparatus; and a locking surface 3*b* (locking portion) for locking of the sealing member 2 into the main assembly side of apparatus when the sealing member 2 and the developer supply container 1 are moved away from each other. Thus, by the drive receiving surface 3*a* and the locking surface 3*b*, the engaging projection 3 performs two different functions, namely, a rotationally driving function and a positionally regulation function for the developer supply container 1.

According to such a structure, the opening and closing operation of the sealing member 2 and the driving force transmitting operation can be accomplished by a single sealing member, so that inexpensive and compact developer supply container can be provided.

The engaging projection 3 is preferably in general provided integrally with the sealing member 2 from the standpoint of reduction of the number of constituent parts, but a separate member for the engaging projection 3 may be mounted to the sealing member 2.

When the engaging projection 3 and the sealing member 2 are integrally provided, slits 2*e* or the like are formed on both the drive receiving surfaces 3*a* of the engaging projection 3, so that only the engaging projection 3, can relatively deformable elastically toward the inside. This is because the engaging projection 3 is displaced by the action of the main assembly 100 of apparatus to effect removal of the transmission of driving force, as will be described hereinafter.

In this embodiment, the engaging projection 3 is integral with the sealing member 2.

The free end portion of the engaging projection 3 is provided with a taper 3*c* so as to permit smooth insertion when the sealing member 2 is inserted into the driving portion 20 of the main assembly 100 of apparatus.

Referring again to FIGS. 12 and 13, the description will be made as to the structure of the disengaging portion.

The engaging projection 3 described above is provided at each of four positions which are diametrically opposed to each other, and corresponding four disengaging portions 4 are formed on elastically deformable supporting portions 2*f* where the engaging projections 3 are also formed. Further, the slits 2*e* are formed on the both sides of the supporting portions 2*f*, so that the engaging projections 3 and the discharging portions 4 are elastically deformed inward. If the force application is stopped, the original position is restored. Accordingly, the disengaging portions 4 have a relatively small thickness to permit the elastic deformation, and the material therefor is selected in consideration of such an elastic deformation.

It is preferable that sealing member 2 is manufactured through an injection molding from a plastic resin material or the like, but another material, or another manufacturing method is usable. They may be provided by connecting separate members. The sealing member 2 desirably has a proper elasticity since it is press-fitted into the opening 1*a* to seal it. The best material is low density polyethylene, and preferable materials are polypropylene, linear chain polyamide, Nylon (tradename), high density polyethylene, polyester, ABS, HIPS (high-impact polystyrene) or the like.

By employing an elastically deformable elastic member for the driving force receiving portion 2*c* and for the disengaging portion 4, the locking and releasing between the driving portion 20 and the driving force receiving portion 2*c* can be accomplished readily. The above-described materials have proper elasticities, and therefore, the engagement and disengagement of the driving portion 20 and the driving force receiving portion 2*c* are easily effected with sufficient durability. The disengaging portions 4 are provided corresponding to the number of the engaging projections 3, so that such a plurality of engaging projections 3 can be uniformly displaced by corresponding disengage portions.

(Driving Force Receiving Portion)

Figure 15:
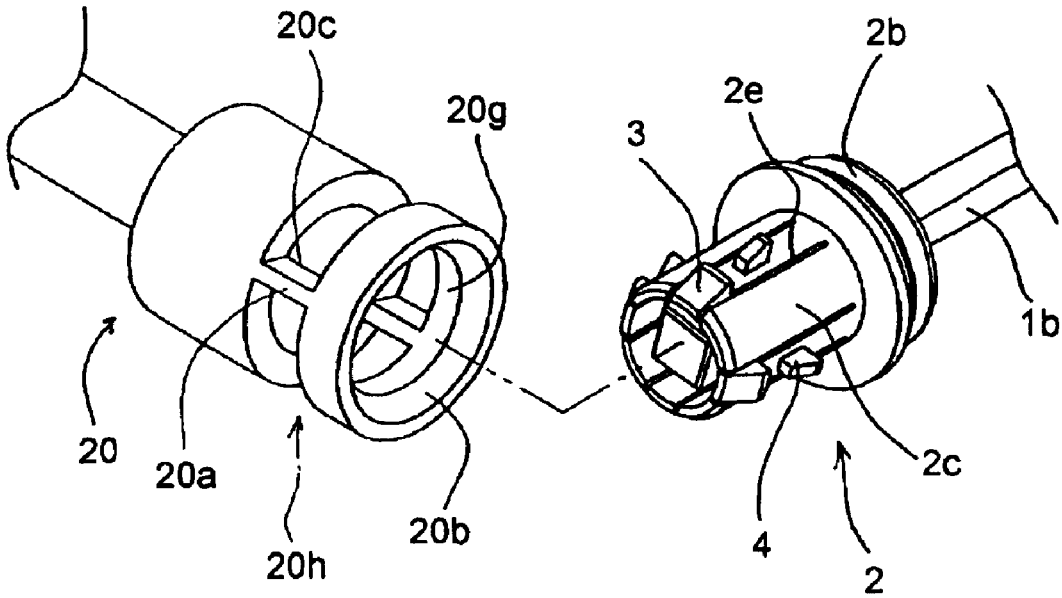
FIG. 15 is a perspective view of a driving force transmitting portion and a driving force receiving portion.

Referring to FIG. 15, the description will be made as to the structure of the driving force receiving portion 2*c* provided in the sealing member 2, which is used for the developer supply container according to the present invention. FIG. 15 is a perspective view showing an embodiment of a combination of a driving force transmitting portion of the image forming apparatus main assembly side and the driving force receiving portion.

In this embodiment, the sealing member 2 is provided with the driving force receiving portion 2*c* in the form of a cylinder, which receives the driving force from the driving force transmitting portion 20 provided in the developer supply apparatus 400.

In the cylindrical driving force receiving portion 2*c* of the sealing member 2, the four parts provided with the respective flexible engaging projections 3 which are diametrically opposed to each other and are elastically deformable as described above, such that parts are easily and elastically deformed by the engaging projection 3 being pressed by the driving portion 20.

On the other hand, the driving portion 20 provided in the main assembly 100 side of the apparatus is constructed so as to be locked with the engaging projection 3 of the sealing member 2. When the sealing member 2 is inserted into the driving portion 20, the smooth insertion is accomplished by providing the driving portion 20 with a tapered surface 20*b* defining gradually decreasing inner diameter at the free end of the driving portion 20. The sealing member 2 is smoothly inserted into the driving portion 20 because of the provision of the tapered surface 20*b*.

The driving portion 20 is provided with an engaging rib 20*a* for rotating the developer supply container 1, and the engaging rib 20*a* locks the engaging projection 3 to transmit the rotational driving force to the sealing member after the sealing member is inserted.

Figure 16:
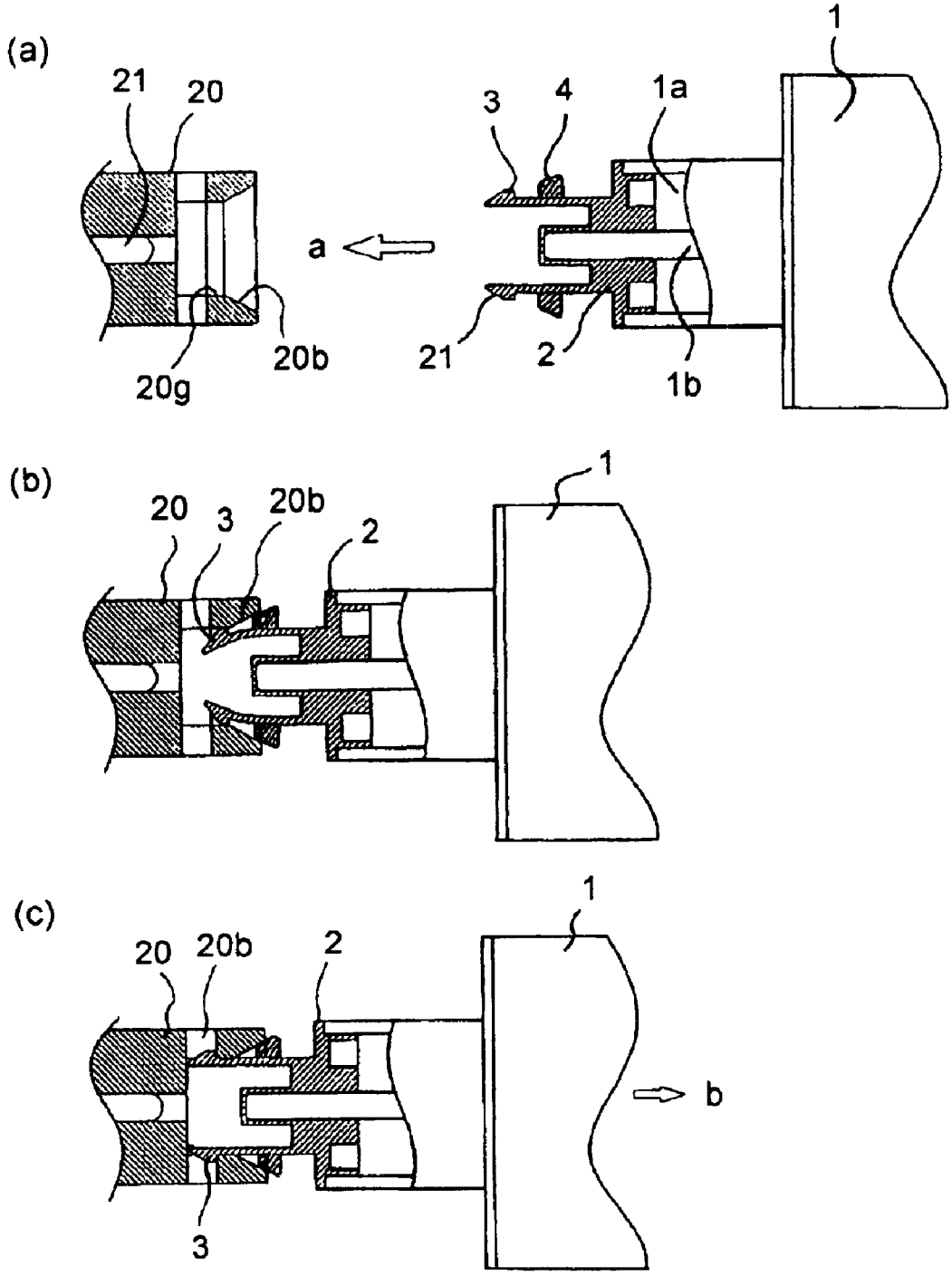
FIGS. 16(*a*), 16(*b*), and 16(*c*) are partially sectional views illustrating engaging action of a drive transmitting portion of the developer supply container, in which FIG. 16(*a*) shows a state before insertion of the developer supply container, FIG. 12(*b*) shows a state in the process of insertion, FIG. 12(*c*) shows a state after the completion of inserting operation.

Referring to FIG. 16, the engagement between the driving portion 20 and the sealing member 2 in this embodiment will be described.

In FIG. 16, (a) shows a state when the user is setting a new developer supply container 1 in the direction indicated by an arrow a in order to install it into the main assembly 100 of the apparatus, in which the developer supply container 1 is not yet been engaged with the driving portion 20 in the main assembly of apparatus.

When the developer supply container 1 is further inserted, the engaging projection 3 of the sealing member 2 is brought into contact with the tapered surface 20*b* of the driving portion 20, as shown in (b) in FIG. 16, and the engaging projection 3 is being guided by the tapered surface 20*b* while being elastically deformed toward inside.

With the further insertion of the developer supply container 1, the engaging projection 3 passes by the straight portion 20*g* continued from the tapered surface 20*b*, the engaging projection 3 restores because of the provision of the space portion 20*h* not having the engaging rib 20*a*, by which the engaging projection 3 is locked with the driving portion 20, as shown in (c) in FIG. 16. In the state, the engaging projection 3 is firmly locked relative to the driving portion 20, and the position of the sealing member 2 in the thrust direction (axial direction) is substantially fixed relative to the main assembly of apparatus.

Figure 10:
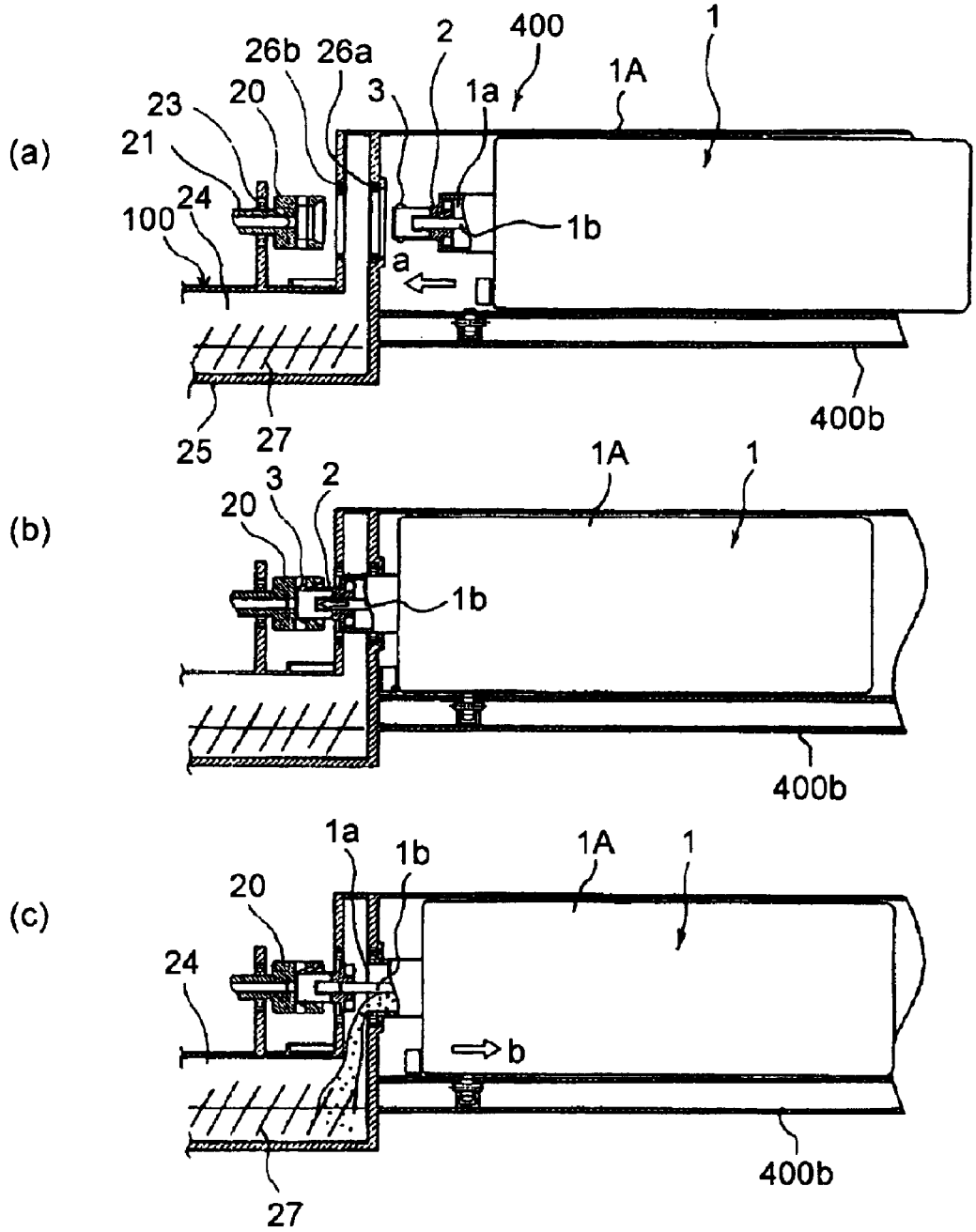
FIGS. 10(*a*) and 10(*b*) are sectional views illustrating a developer supply container mounting operation of the developer supply container, wherein FIG. 10(*a*) shows an initial stage of the mounting operation, FIG. 10(*b*) shows the state in the process of mounting operation, and FIG. 10(*c*) shows the state after the completion of the mounting operation.
Figure 11:
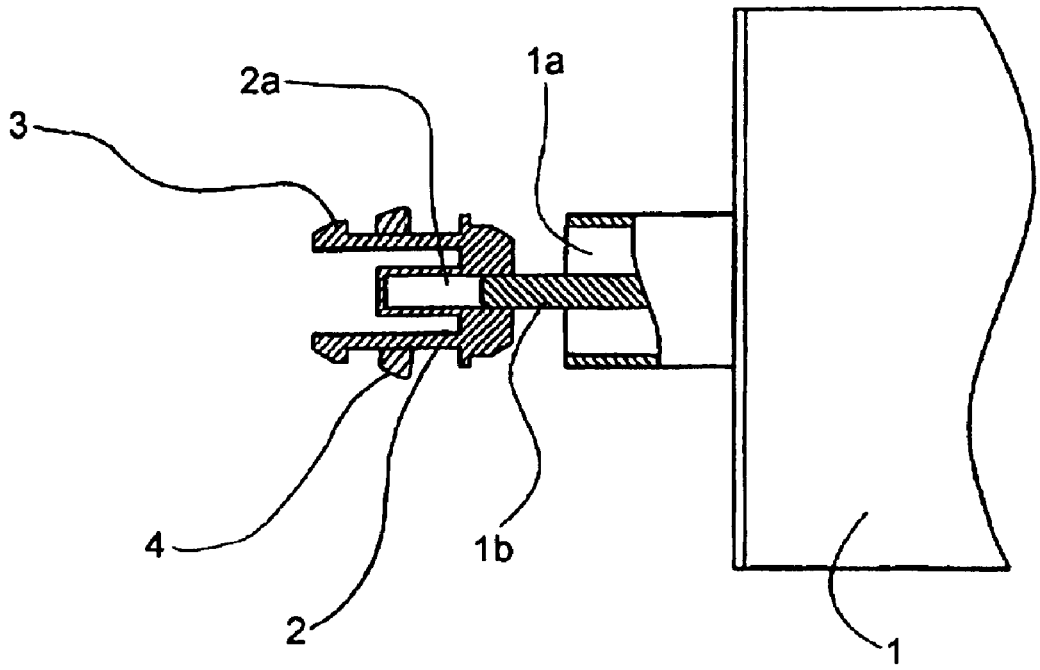
FIG. 11 is a partly enlarged section of view of a drive transmitting portion.

Therefore, even if the developer supply container 1 is then retracted in the direction indicated by an arrow arrow b, as shown in (c) in FIG. 10, the sealing member 2 does not move in the same direction, but is firmly fixed to the driving portion 20. On the other hand, since only the developer supply container 1 is retracted, the sealing member 2 is separated away from the developer supply container 1 with certainty, so that opening 1*a* is unsealed or opened. The sliding retracting operation of the developer supply container 1 may be interrelated with the opening and closing operation of the front cover 15 for exchange provided in the main assembly 100 of the apparatus. The retracting operation may also be performed by any method, e.g., wherein the sliding operation may be independently performed by using a separately provided drive motor etc., or as described in this embodiment, the rotation lever 400*d* is separately provided, and the sliding operation may be interrelated with the operation of the rotation lever.

<Disengaging Releasing Method>

Figure 17:
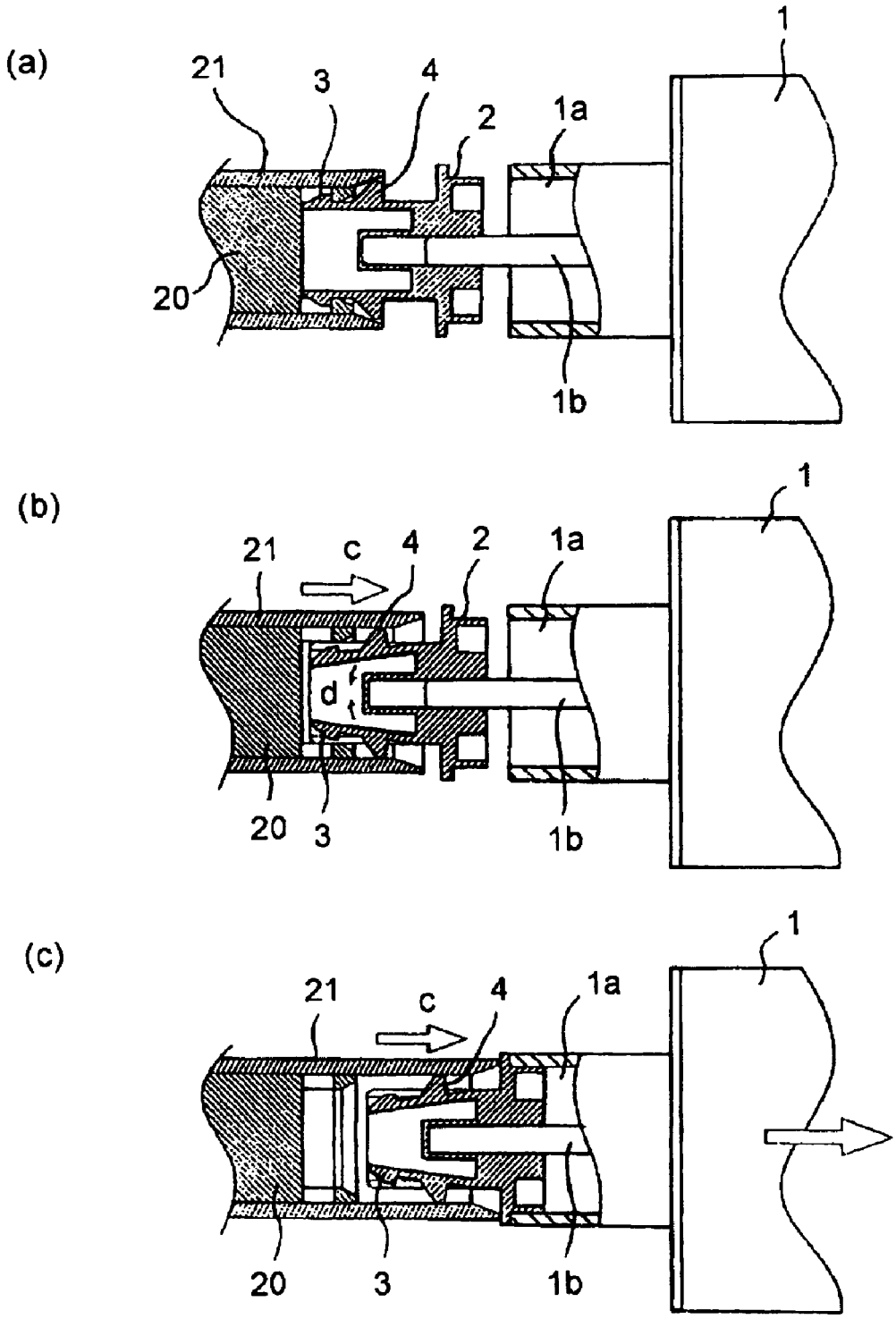
FIGS. 17(*a*), 17(*b*), and 17(*c*) are sectional views illustrating disengagement action at the drive transmitting portion of the developer supply container, wherein FIG. 17(*a*) is before disengagement, FIG. 17(*b*) is in the process of disengagement, FIG. 17(*c*) is after completion of the disengagement action.

Referring to FIG. 17, the description will be made as to disengagement or releasing between the engaging projection 3 and the main assembly driving portion 20.

In FIG. 17, (a) shows a state in which the developer supply is completed, and the opening 1*a* of the developer supply container 1 is in an open state.

When the locking (engagement) between the driving portion 20 and the sealing member 2 is released, as shown in (b) of FIG. 17, the pushing member 21 is announced in a direction indicated by an arrow c to the disengaging portion 4 at the free end of the sealing member 2, by which the disengaging portion 4 is elastically deformed inwarding a direction indicated by an arrow d under pressure of the inner peripheral surface of the pushing member 21, and correspondingly, the engaging projection 3 integral with the disengaging portion 4 deforms toward inside. By this, the engaging projection 3 is disengaged from the main assembly driving portion 20. Thereafter, the pushing member 21 further advances in the direction of arrow c, by which the sealing member 2 is returned to the sealing position of the developer supply container 1 as shown (c) of FIG. 17. Then, the developer supply container 1 per se is retracted by the pushing member 21 to slide the developer supply container 1 to a position to facilitate the user who is going to remove it.

As for the driving structure for the pushing member 21, similarly as in the above described manner, it may be interrelated with the opening and closing operation of the front cover 15 for exchange of the main assembly 100 of apparatus such that when the front cover 15 is opened, the pushing member 21 moves in the direction of arrow c to effect disengagement between the sealing member 2 of the toner bottle 1 and the driving portion 20, and when the front cover 15 is closed, it is advanced in a direction opposite from that of arrow c. Alternatively, a driving motor or the like is separately provided and used to effect the disengaging operation independently. In another alternative, as described in this embodiment, the rotation lever 400*d* is separately provided, and the disengaging operation is interrelated with the operation of the rotation lever. Further, it is also possible to dispose the pushing member within the driving portion as shown in FIGS. 10 and 16.

<Developer Supply Operation>

Referring to FIG. 7, (a) to (c), the developer supply operation from the developer supply container in this embodiment, will be described. FIG. 10, (a)–(c) illustrates the process of developer supply in which the developer supply container 1 of this embodiment is inserted into the main assembly 100 of the apparatus.

As shown in the Figure, the main assembly 100 of the its apparatus is provided with a developer supply apparatus (device) 400, and the developer supply apparatus 400 is provided with a driving portion (driving force transmitting portion) 20 for correcting with and rotating the developer supply container 1. The driving portion 20 is rotatably supported by bearings 23, and is rotated by an unshown driving motor provided in the main assembly 100 of the apparatus.

The main assembly 100 of apparatus is further provided with a partition 25 constituting a developer supply path (sub-hopper) 24 connecting with a hopper 201*a*, and to the partition 25, inner and outer bearing 26*a*, 26*b* as for rotatably bearing a part of the developer supply container 1 and for sealing the developer supply path 24, are fixed. Furthermore, a screw member 27 is disposed in the developer supply path 24 to feed the developer to the hopper 201*a*.

FIG. 10, (a) illustrates a state of insertion of the developer supply container 1 into the main assembly 100 of the apparatus. One end of the developer supply container 1 is provided with a developer supply opening 1*a*, formed by a cylindrical member in this embodiment, and the opening 1*a* is sealed by a sealing member 2 at the free end of the cylinder.

FIG. 10, (b) shows a state in which the developer supply container 1 has been further inserted, and an engaging projection 3 (locking portion) provided at a free end portion of the sealing member 2 is engaged with the driving portion 20 provided on the apparatus main assembly side.

At this time, since the locking surface provided in the engaging projection 3 is locked with the driving portion 20 against a thrust direction (axial direction) motion, and therefore, as long as the locking is maintained, the sealing member 2 is retained at the fixed position by the driving portion 20.

FIG. 7, (c) shows a state in which after the sealing member 2 and the driving portion 20 are engaged, the developer supply container 1 is retracted in interrelation with a rotating operation of the rotation lever 400*d*, and therefore, the sealing member 2 is relatively away from the developer supply container 1, thus opening the opening 1*a* to enable developer supply.

At the time, the driving shaft 1*b* fixed to the cylindrical portion 1A of the developer supply container 1, is not completely disengaged from the sealing member 2 and a part of the driving shaft 1*b* still remains in the sealing member 2. The driving shaft 1*b* has a non-circular cross-sectional configuration, such as rectangular or triangular shape shape to permit rotational driving force transmission.

When an unshown motor is driven in this state, the rotational driving force is transmitted from the main assembly driving portion 20 to the sealing member 2, and then is transmitted from the sealing member 2 to the driving shaft 1*b*, which rotates the developer supply container 1. Thus, the sealing member 2 has two functions of sealing the opening 1*a* for supplying the developer and of transmitting the rotational driving force to the developer supply container 1 side at the same time.

The developer supply container 1 is rotatably supported by container receiving roller 23 provided on a container receiving table 400*b*, and therefore, can be smoothly rotated by a small driving torque. By the rotation of the developer supply container 1, the developer accommodated in the developer supply container 1 is discharged through the opening 1*a* gradually, and the screw member 27 provided in the developer supply path 24 feeds the developer into the hopper 201*a* provided in the main assembly 100 of apparatus, thus accomplishing the developer supply.

(Exchanging Method for Developer Supply Container)

The description will be made as to an exchanging method of the developer bottle.

With the image forming operation, the developer in the developer supply container 1 is consumed. When substantially all the developer therein is used up, the "no developer" is detected by a detecting means (unshown) provided in the main assembly 100 of the apparatus, and the event is notified to the user by displaying means 100*b* (FIG. 2) such as liquid crystal display. In this embodiment, the exchange of the developer supply container 1 is performed by the user, through the following steps.

First, the front cover 15, for exchange, which is in the close state is rotated about a hinge 18 to an open position indicated in FIG. 3. In interrelation with the action of the rotation lever 400*d* (FIG. 5), the cylindrical portion 1A of the container main body which takes the position indicated in (c) of FIG. 10 is moved in a direction indicated by an arrow a in (a) of FIG. 10. By this, the sealing member 2 which is at an open position (away from the container main body 1A of the developer supply container to open the developer supply opening 1*a*) is press-fitted into the developer supply opening 1*a*, so that developer supply opening 1*a* is plugged (FIG. 10, (b)).

Then, the user draws the vacant developer supply container 1 which has been released from the main assembly 100 of the apparatus out of the main assembly 100 of the apparatus in a direction of arrow b (FIG. 10, (c)) which is opposite from the direction of arrow a (FIG. 10, (a)).

The user then inserts a new developer supply container 1 into the main assembly 100 of the apparatus in the direction of arrow a, rotates the rotation lever 400*d*, and then close the front cover 15. In interrelation with the rotation lever 400*d* rotation, the sealing member 2 locked with the main assembly of the image forming apparatus is moved away from the main body 1A of the container by the developer supplying portion opening and closing means, so that developer supply opening 1*a* is unsealed (FIG. 10, (c)). The foregoing is the exchanging process of the developer supply container.

<Structure for Non-interchangeability>

In he exchange (interchange) of the developer supply container described above in detail, the thing having the most need of avoidance is that a developer supply container accommodating a different type of developer is erroneously set in the main assembly of image forming apparatus. Hereinbelow, an improper interchange-preventing mechanism for preventing such an erroneous setting of the different developer supply container will be described with reference to the drawings.

As shown in FIG. 7, the developer supply container 1 is provided with mounting control projections 1*e* projected from the cylindrical portion 1A of the developer supply container at its trailing end (opposite from the discharge opening 1*a* in the longitudinal direction of the developer supply container 1 in this embodiment) 400*c* is disposed at a receiving opening (ring portion) 400*a* through which the developer supply container 1 can pass in such a state that it is provided with cuts or recesses 400*c*1 (referred to as "cuts" for convenience herein even in the case where a single-piece product partly has a recess portion) which is changed depending on the color or the kind of developer for use in the developer supply container 1. By the combination of the cuts 400*c*1 with the mounting control projections 1*e* provided to the developer supply container 1, control as the whether the developer supply container 1 to be mounted is mountable or not is performed. The cuts 400*c*1 are designed to have a configuration and a positional phase so that the mounting control projections 1*e* (regulation portion) are substantially fitted into the cuts 400*c*1 (regulation member). Herein, "substantially fitted" means not only the case where the configuration of these projections and cuts are completely fitted with each other but also the case where the projections are fitted into the cuts with play to some extent. In other words, in the present invention, "substantially fitted" means the case where the projections (regulation portion) are fitted into the cuts (regulation member) within such a scope that "(improper) interchangeability prevention" as an object can be achieved with respect to the configuration and the positional phase of the projections (regulation portion) and the cuts (regulation member).

FIG. 4 is, as described hereinabove, a perspective view showing the developer supply apparatus 400 and the developer supply container 1 to be mounted therein. The user inserts the developer supply container 1 from the indicated state in the direction of the indicated arrow. At that time, an inner diameter of the mounting control member 400*c* provided with the developer supply apparatus 400 corresponds to such a size that the container main body 1A of the developer supply container 1 can snugly pass through the mounting control member, so that when the developer supply container 1 is further inserted in the indicated arrow direction shown in FIG. 4, the mounting control member 400*c* of the developer supply apparatus 400 and the mounting control projections 1*e* are placed in an interaction state as shown in (b) of FIG. 18.

Figure 18:
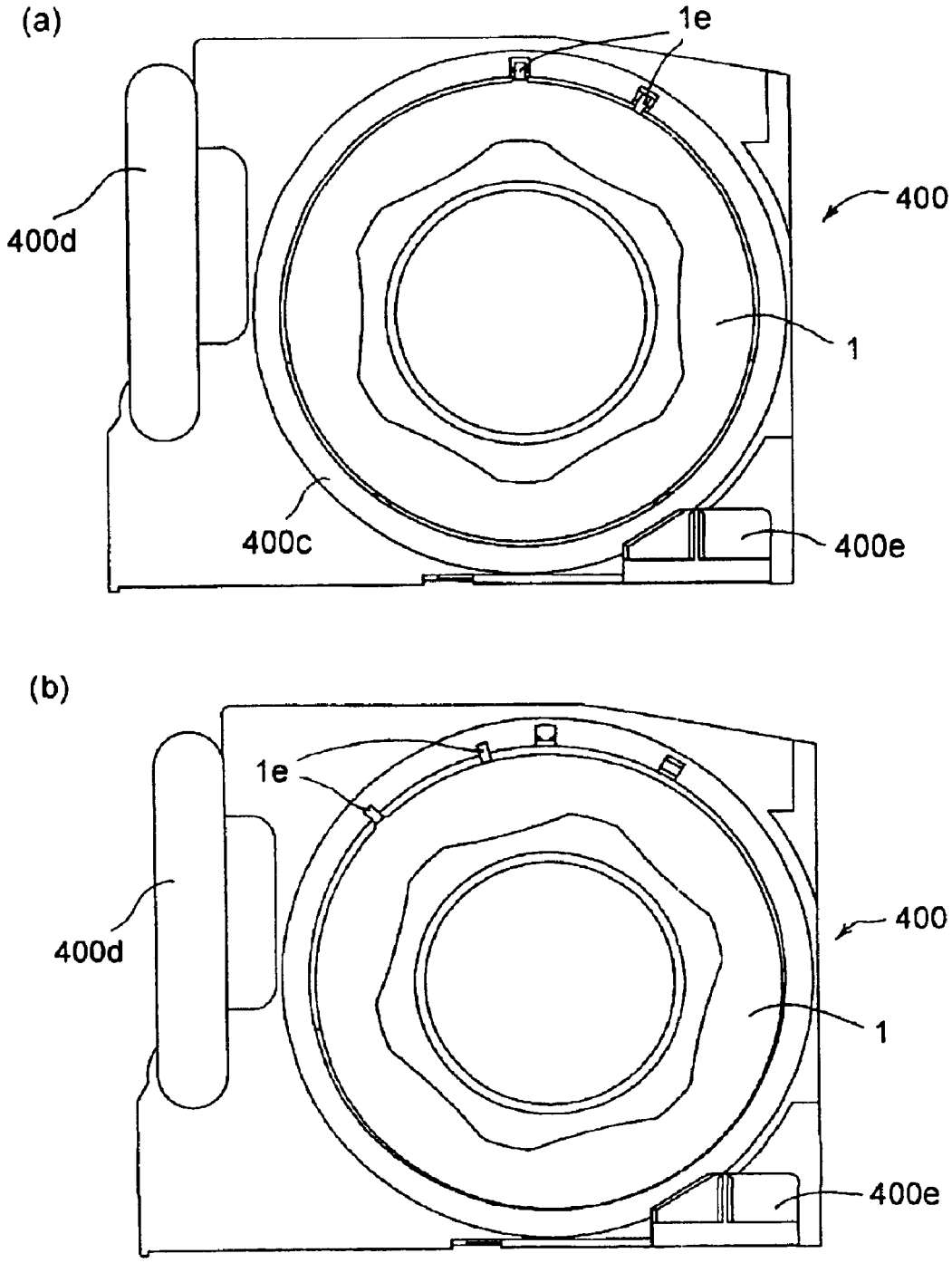
FIGS. 18(*a*) and 18(*b*) are views illustrating mounting operation of the developer supply container into the developer supply apparatus, wherein FIG. 18(*a*) is after mounting, and FIG. 18(*b*) is before mounting.

For this reason, the user adjusts the positional phase relationship between the mounting control projections 1*e* provided to the developer supply container 1 and the cuts 400*c*1 provided in the mounting control member 400*c* of the developer supply apparatus 400 as shown in (a) of FIG. 18, by which it becomes possible to mount the developer supply container 1 into the developer supply apparatus 400. In such a phase-adjusted state, when the developer supply container 1 is further inserted in the direction of the arrow a shown in FIG. 8 (the arrow direction shown in FIG. 4) on the developer supply container receiving table 400*b* of the developer supply apparatus 400, the mounting (setting) operation of the developer supply container 1 is completed (FIG. 6).

After the mounting control projections 1*e* of the developer supply control 1 are engaged with the mounting control member 400*c* of the developer supply apparatus 400 through the positional phase adjustment (alignment) by the user, they are always placed in such a state that their engaged state is retained during the sliding movement of the developer supply container 1 for the opening and closing operation of the above-mentioned sealing member 2 of the developer supply container 1 or during the rotation of the developer supply container 1 for supplying the developer to the developer supply apparatus 400. Further, the mounting control member 400*c* is rotatably attached to the developer supply apparatus 400 through a conventionally known means such as bearings or the like. As a result, the mounting control member 400*c* is rotated by the rotation of the developer supply container 1 without changing its position relative to the developer supply container 1.

According, as the operation at the time of exchanging the developer supply container 1, the user is required to effect the positional phase adjustment (alignment) only one time when the developer supply container 1 is mounted into the developer supply apparatus 400. By doing so, it is possible to readily effect the exchange operation with no positional phase adjustment at the time of demounting the developer supply container 1 from the developer supply apparatus 400.

In the present invention, the mounting control projection 1*e* may preferably be designed so that it is projected form the cylindrical portion 1A of the developer supply container 1 by 1–10 mm, more preferably 2–5 mm. If the height of projection is below 1 mm, a degree of interaction of the mounting control projection 1*e* with the mounting control member 400*c* provided on the developer supply apparatus 400 side becomes small when parts dimensional tolerances and play at the time of mounting the developer supply container 1 are taken into account. Further, in view of deformation of the respective members at the time of mounting operation, there is a possibility that a sufficient non-interchangeability effect is not achieved. In addition, if the height is small, viewability from the user side becomes worse and operability at the time of positional phase alignment is undesirably lowered. On the other hand, if the height is above 10 mm, although the above difficulties are obviated, the developer supply container receiving opening 400*a* and the mounting control member 400*c* of the developer supply apparatus 400 are required to be made larger in size, thus being undesirable in terms of savings in space and cost. From these viewpoints, in this embodiment, the height of the mounting control projection 1*e* from the outer peripheral surface of the developer supply control 1 is set to 3 mm.

Figure 19:
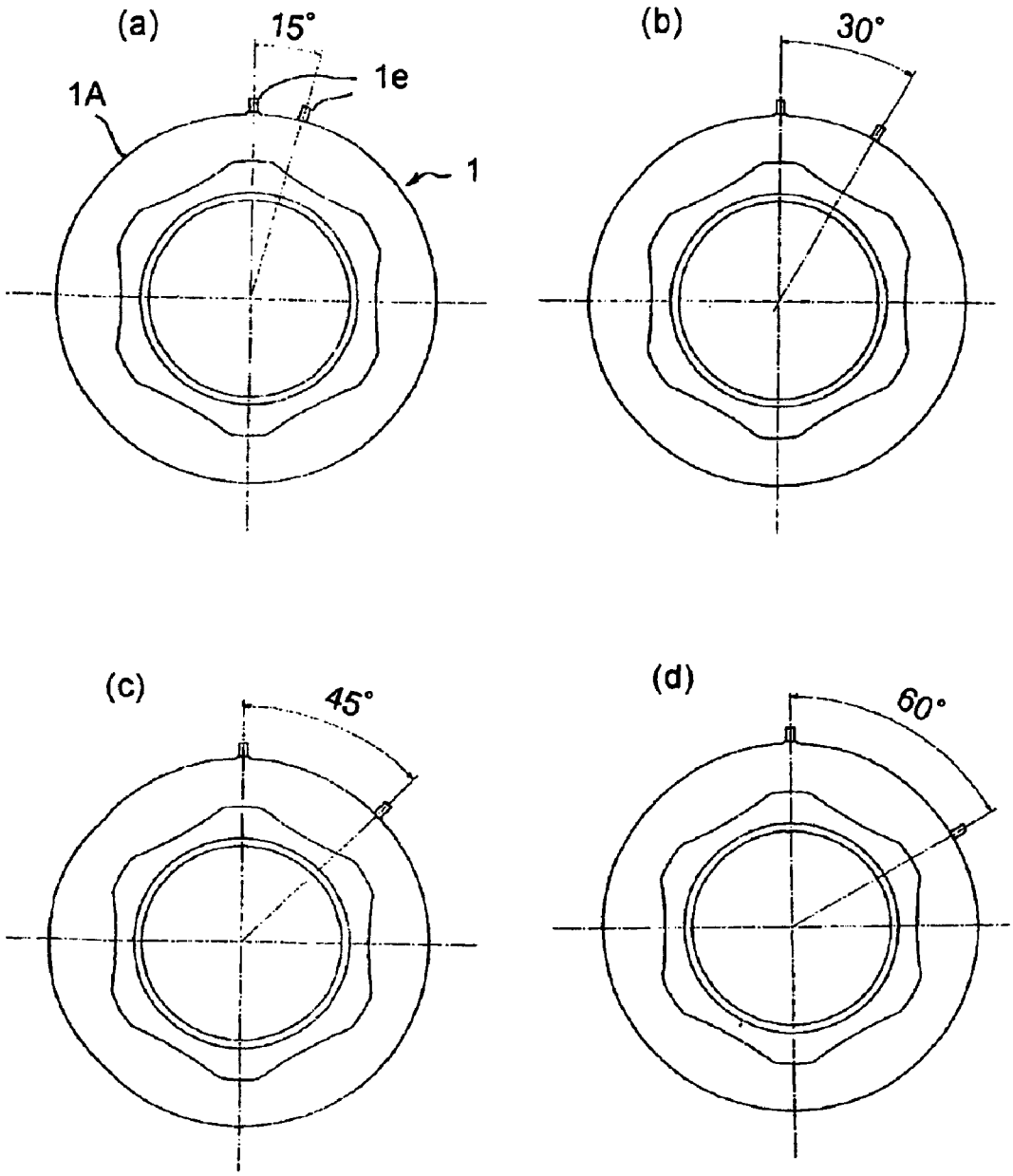
FIGS. 19 and 20 are views each illustrating an embodiment of arrangement of control projections provided to a developer supply container.

With respect to arrangement and design of the projection 1*e*, it is possible to arbitrarily set a width, a spacing, the number, and a configuration, depending on the kind of the developer supply container 1 used. In this embodiment, the projection 1*e* is provided at two positions as shown in FIG. 19 so as to permit mounting of only one kind of the developer supply container 1 into one model of the developer supply apparatus 400. By changing the spacing between the two projections 1*e*, the developer supply container 1 used is discriminated from other developer supply containers 1 for other models. In FIG. 19, four arrangement examples of the projections 1*e* having different spacings including (a) 15 degrees, (b) 30 deg., (c) 45 deg., and (d) 60 deg. as an angle therebetween. By using these (four) developer supply containers 1, it is possible to classify one developer supply container 1 into four types developer supply containers. For example, by providing commonality of most of developer supply containers 1 for supplying developers of four colors to a color copying machine and using a metal mold which is nesting-adjusted with respect to only the mounting control projection portion, it is possible to considerably cut down on costs.

Figure 20:
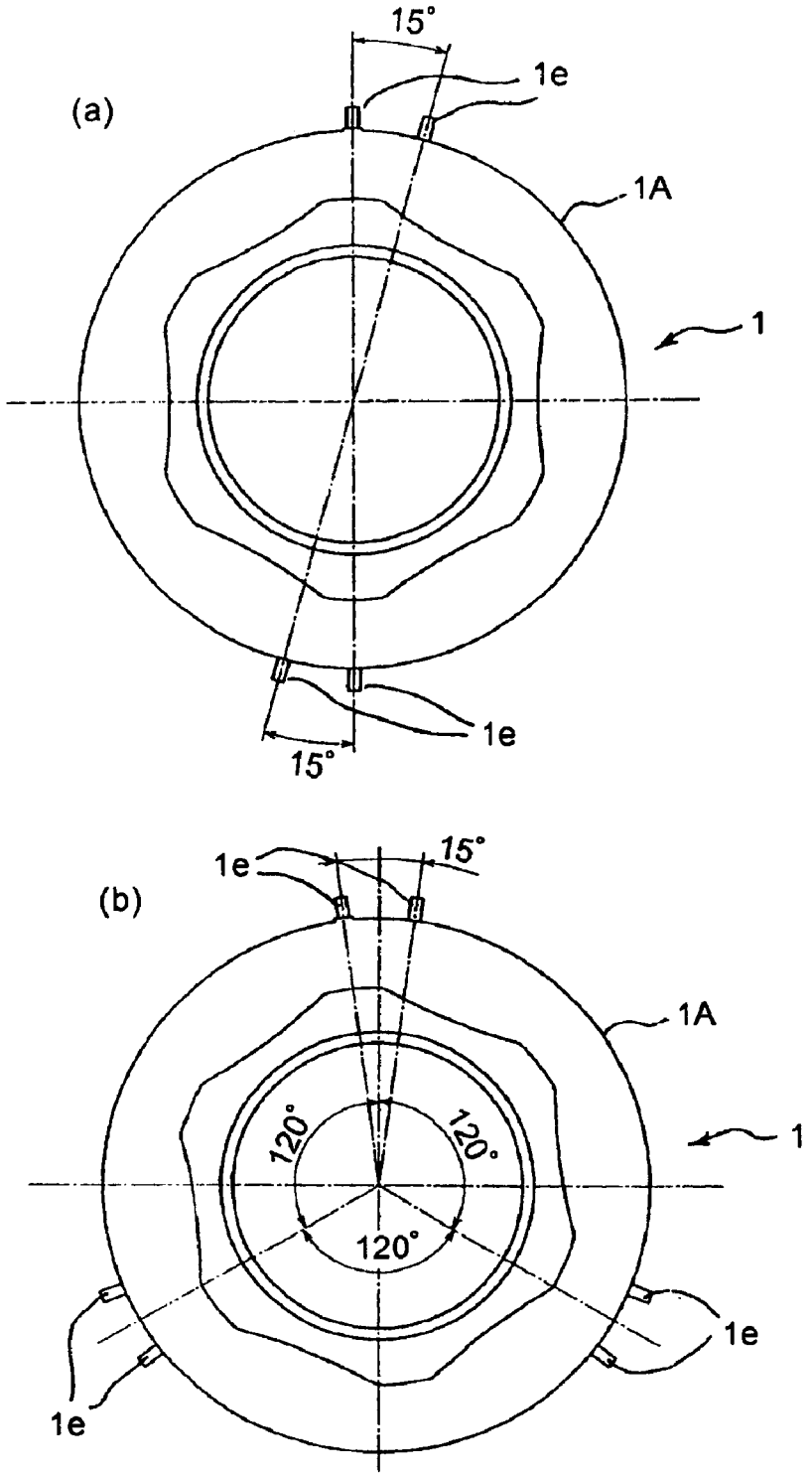

In this embodiment, the pair of (two) mounting control projections 1*e* are provided in only one direction. In this case, however, it is necessary for the user to rotate the developer supply container 1 by 180 deg. at worst, but it becomes possible to reduce a degree of rotation of the developer supply container 1 by the user at the time of positional phase alignment to further improve the operability by providing the pair of mounting control projections 1*e* in two directions diametrically opposite to each other as shown in (a) of FIG. 20 or in three directions each at a spacing angle of 120 deg. as shown in (b) in FIG. 20 and by disposing cuts 400*c*1 of the mounting control member 400*c* provided to the developer supply apparatus 400 so as to correspond to the mounting control projections 1*e*, respectively. Such an effect can also be achieved by providing the pair of mounting control projections 1*e* in only one direction as in this embodiment and providing the cuts 400*c*1 of the mounting control member 400*c* in the above described two or three directions.

As for the arrangement position of the mounting control member 400*c* to be provided to the developer supply apparatus 400, there is no problem if the position can basically prevent a developer supply container 1 accommodating different developer from being mounted into the developer supply apparatus 400 before the developer supply control 1 is completely mounted into the developer supply apparatus 400 and the sealing member 2 of the developer supply apparatus 1 is unsealed. However, since the user effects the positional phase alignment at the time of mounting, in order that the user can readily visually identify the mounting control member 400*c* of the developer supply apparatus 400 and the mounting control projection(s) 1*e* of the developer supply container 1 and that the fact that the developer supply container 1 is a different type of developer supply container 1 can positively appeal to the user even if the user is going to mount the different type of developer supply container 1 into the developer supply apparatus 400, the mounting control member 400*c* of the developer supply apparatus 400 may preferably be disposed in the neighborhood of the container receiving opening 400*a* as close as possible. For this reason, in this embodiment, the mounting control member 400*c* is disposed at the entrance of the developer supply control receiving opening 400*a* of the developer supply apparatus 400.

As for the width (thickness) of the mounting control member 400*c* in the insert (mounting) direction of the developer supply control 1, if the width is excessively narrow, the mounting control member 400*c* has a low stiffness, thus being undesirable in terms of reliability of non-interchangeability. On the other hand, if the width is excessively board, the cost of the mounting control member 400*c* with the developer supply apparatus 40 becomes large, so that a power required for rotating the mounting control member 400*c* is increased to exert an excessive load on the driving force transmitting mechanism for rotating the developer supply container 1 by which the mounting control member 400*c* is rotated. For these reasons, the width of the mounting control member 400*c* may preferably be in the range of approximately 2–50 mm, in which the above-mentioned difficulties are not caused to arise. Further, in this embodiment, as described in the foregoing, the developer supply container 1 is, after being inserted into the developer supply apparatus 400, slidably moved in the insertion direction relative to the mounting control member 400*c* in order to open and close the sealing member 2 of the developer supply container 1. In that instance, the width of the mounting control member 400*c* may desirably be set as not to be disengaged from the mounting control projections 1*e* of the developer supply container 1. In this embodiment, a length of sliding of the developer supply container 1 is about 13 mm, so that the width of the mounting control member 400*c* is set to 15 mm.

Based on the above described structure, it becomes possible to ensure non-interchangeability at the time of mounting the developer supply container 1 into the developer supply apparatus 400 with reliability only by performing such an operation that the positional phase alignment with respect to the combination of the mounting control projections 1*e* with the cuts 400*c*1 provided to the developer supply apparatus 400. Further, since the mounting control portion and the mounting control member and so on for permitting the non-interchangeability operation are disposed on the side closest to the user in the insertion direction, so that the user can readily perform the above-mentioned positional phase alignment by eyes. In addition, even if the user is going to erroneously mount the different type of developer supply container 1, it becomes possible to easily notify the user of that event.

Further, at the time of demounting and mounting of the developer supply container 1, the user can smoothly demounts and mounts the developer supply container 1 only by pulling out it without effecting the positional phase alignment of the mounting control member 400*c* provided to the developer supply apparatus 400 with the mounting control projection(s) 1*e* provided to the developer supply container 1, thus resulting in remarkably improved operability. In the case of omitting the above-mentioned structure, it is necessary to provide the developer supply apparatus 400 with rotation stop position regulating means for the developer supply container 1 in order to improve the operability described above. In this embodiment, however, such a necessity is avoided and it becomes possible to provide a compact image forming apparatus main assembly 100 at low cost.

According to the structure of the developer supply apparatus exemplified in this embodiment, even if the different type of developer supply container 1 is going to be mounted, the developer supply container 1 is not completely mounted into the developer supply apparatus 400, so that the cap member for sealing the opening of the developer supply container 1 is not engaged with the developer supply apparatus 400. As a result, it becomes possible to solve, with reliability, such a worst problem that the different type of developer is supplied into the main assembly of image forming apparatus without causing erroneous opening of the cap member and erroneous transmission of the driving force from the main assembly to the developer supply container.

Further, in this embodiment, the user operates the lever at the time of mounting the developer supply container 1. In the case of erroneous mounting of the developer supply container 1, the developer supply container 1 is not completely inserted, so that the lever operation cannot be performed consequently due to interference between the developer supply container 1 and the lever even when the lever operation is going to be performed. As a result, the above-mentioned problem can be solved more reliably.

Although the lever operation is performed in this embodiment, a similar effect can also be achieved by employing, e.g., a door for exchanging the developer supply container. Accordingly, in the present invention, it is possible to obviate the need for providing a particular mechanism for erroneous developer supply prevention to the image forming apparatus main assembly, etc. as in the conventional image forming apparatus. As a result, it becomes possible to provide a compact image forming apparatus at low cost with high reliability.

(Embodiment 2)

Figure 21:
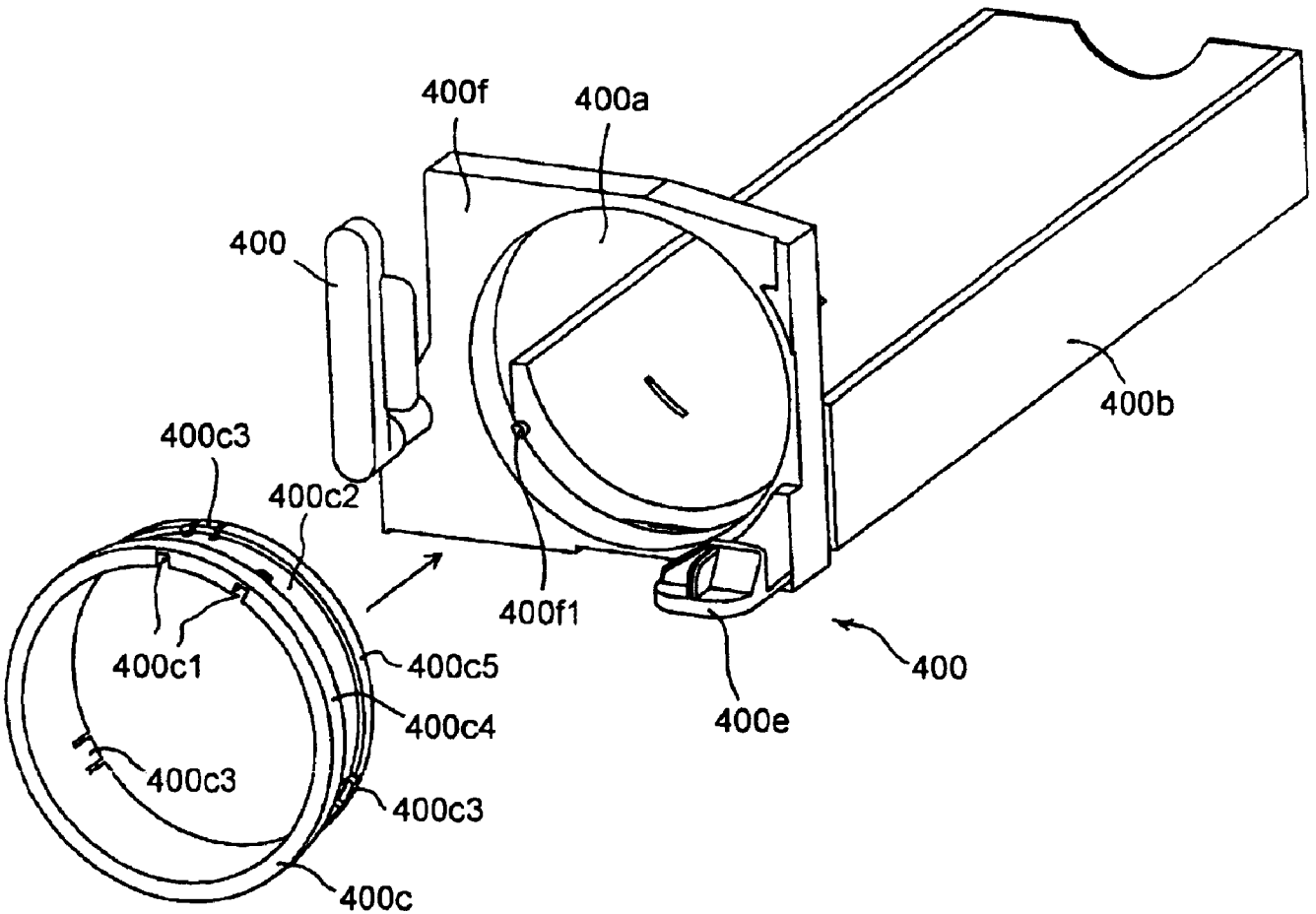
FIG. 21 is a perspective view showing a developer supply apparatus and a mounting control member according to a second embodiment of the present invention.
Figure 22:
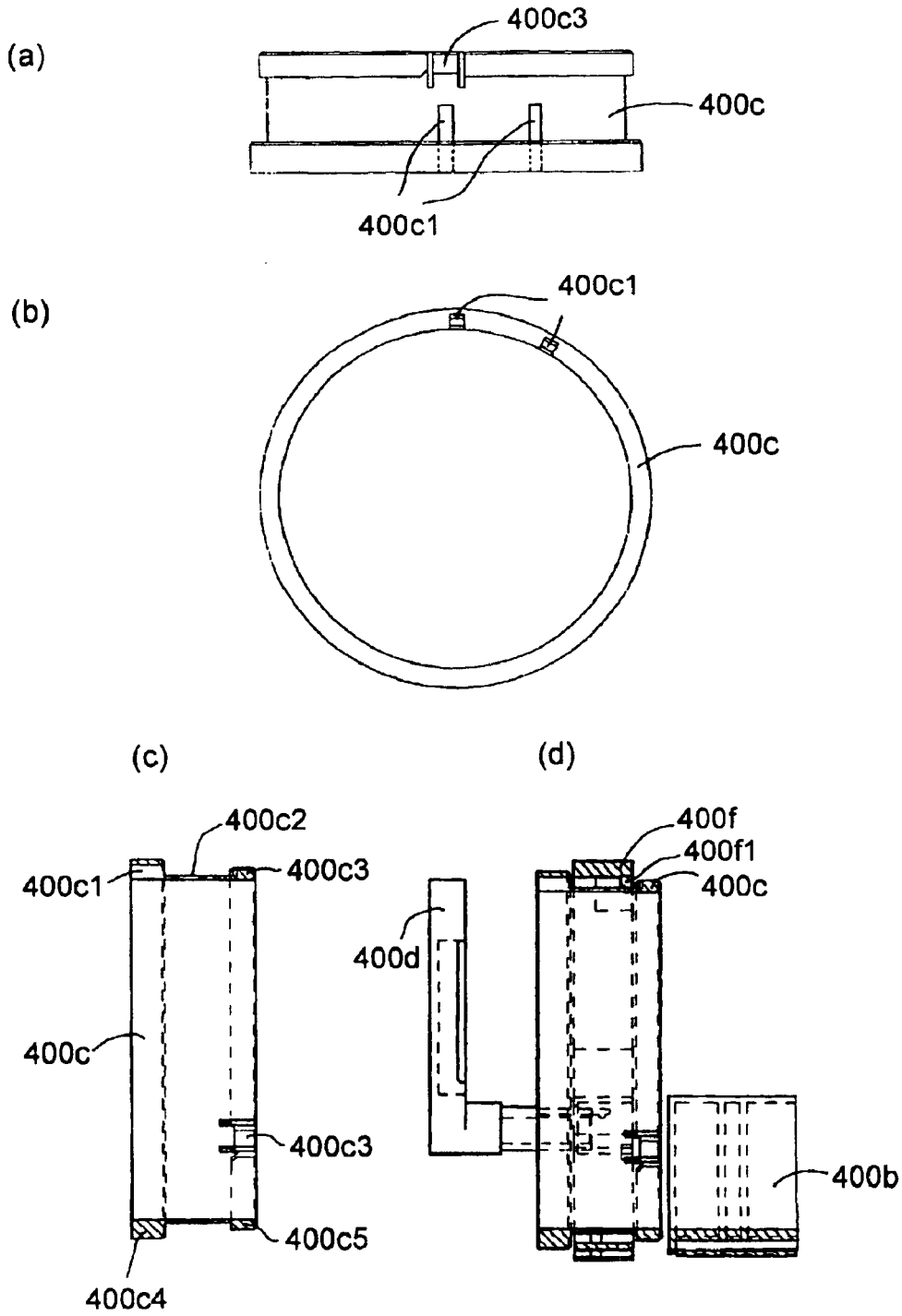
FIGS. 22(*a*), 22(*b*), 22(*c*), and 22(*d*) are views illustrating the mounting control member of FIG. 21 and a mounted state thereof into the developer supply container, wherein FIG. 22(*a*) is a top view, FIG. 22(*b*) is a front view, FIG. 22(*c*) is a sectional view, and FIG. 22(*d*) is a partially sectional view showing the mounted state.
Figure 23:
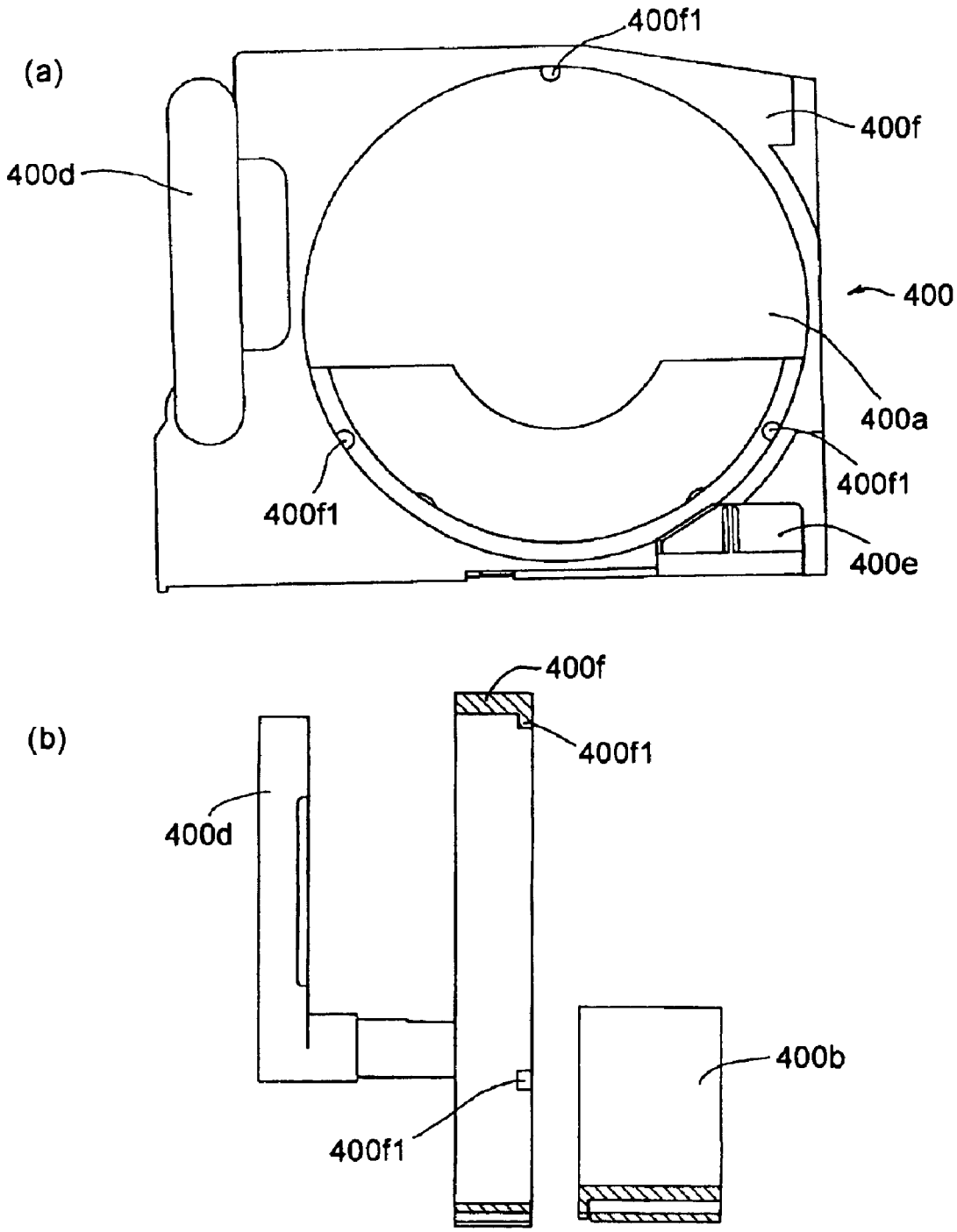
FIGS. 23(*a*) and 23(*b*) are explanatory views of the developer supply apparatus according to the second embodiment, wherein FIG. 23(*a*) is a partly broken front view, and FIG. 23(*b*) is a partially sectional view.

A second embodiment according to the present invention will be described with reference to FIGS. 21–23. Repetitive description on members and functions identical to those in Embodiment 1 will be omitted. FIG. 21 is a perspective view showing a developer supply apparatus and a mounting control member used in this (second) embodiment. FIG. 22 is views illustrating the mounting control member of FIG. 21 and a mounted state thereof into the developer supply container, wherein (a) is a top view, (b) is a front view, (c) is a sectional view, and (d) is a partially sectional view showing the mounted state. FIG. 23 is explanatory views of the developer supply apparatus according to this embodiment, wherein (a) is a partly broken front view, and (b) is a partially sectional view.

In Embodiment 1, as the means for mounting the mounting control member 400*c* to the developer supply apparatus 400, the bearings or the like are used for fixation. On the other hand, in this embodiment, friction of the mounting control member 400*c* with the developer supply apparatus 400 is reduced without using the bearings.

FIG. 21 shows a state before the mounting control member 400*c* is mounted to the developer supply apparatus 400, and the mounting control member 400*c* is to be inserted in a direction of the indicated arrow.

As shown in FIG. 22, the mounting control member 400*c* according to this embodiment, includes cuts 400*c*1 through which mounting control projections 1*e* provided to the developer supply container 1 are capable of being passed; a groove portion 400*c*2 having a width which is somewhat larger than a width of an opening member 400*f* having a container receiving opening 400*a* provided to the developer supply apparatus 400; elastically deformable members 400*c*3 which are elastically deformed to permit a so-called "snap-fit" type engagement or locking; a major diameter engaging portion 400*c*4 having an outer diameter which is larger than an inner diameter of the container receiving opening 400*a*; and a minor diameter engaging portion 400*c*5 having an outer diameter which is considerably smaller than the inner diameter of the container receiving opening 400*a* and does not permit passing of engaging projections 400*f*1 (as shown in FIG. 23) therethrough.

As shown in FIG. 21, when the mounting control member 400*c* is inserted in a direction of the indicated arrow so as to mount it into the container receiving opening 400*a* of the developer supply apparatus 400, the minor diameter engaging portion 400*c*5 passes through the receiving opening 400*a* since the outer diameter thereof is smaller than the inner diameter of the receiving opening 400*a* but cannot pass through the engaging projection 400*f*1 projected from the boundary between the receiving opening 400*a* and the opening member 400*f*. As a result, the mounting control member 400*c* is not engaged into the receiving opening 400*a*. However, the minor diameter engaging portion c5 is provided with the elastically deformable portion 400*c*3, which can be elastically deformed inwardly, disposed opposite to the engaging projection f1, so that the elastically deformable portion 400*c*3 interferes or interacts with the engaging projection 400*f*1 to undergo inward displacement. As a result, the elastically deformable portion 400*c*3 and the minor diameter engaging portion 400*c*5 pass through the engaging projection. Thereafter, the elastically deformable portion 400*c*3 is released from the interference with the engaging projection f1 to be placed in such a state that the mounting control member 400*c* is regulated in a direction opposite to the indicated arrow direction shown in FIG. 21 relative to the container receiving opening 400*a*.

On the other hand, the major diameter engaging portion 400*c*4 opposite from the minor diameter engaging portion 400*c*5 through the groove portion 400*c*2 has a lager outer diameter than the inner diameter of the receiving opening 400*a*, thus bumping against the opening member 400*f* (receiving opening 400*a*). Accordingly, the mounting control member 400*c* is placed in such a state that its movement in the thrust direction is regulated by the receiving opening 400*a* of the developer supply apparatus 400.

Further, the mounting control member 400*c* is attached to the engaging projection 400*f*1 (at three positions in this embodiment) provided in the receiving opening 400*a* in the radial direction so that it is rotatably supported. However, in a state that the developer supply container 1 is mounted into the developer supply apparatus 400, the mounting control member 400*c* is supported by the developer supply container 1 and there is a slight clearance between the engaging projection 400*f*1 and the groove portion 400*c*2.

Accordingly, when the mounting control member 400*c* is rotated together with the developer supply container 1, friction between the mounting control member 400*c* and the opening member 400*f* can be basically prevented. Even if the friction therebetween is caused to occur, the contact point between the mounting control member 400*c* and the opening member 400*f* is only the engaging projection f1, so that it becomes possible to considerably reduce the frictional force. As a result, it is possible to prevent an increase in rotational torque of the developer supply container 1.

As described above, according to this embodiment, it is possible to provide a non-interchangeability ensuring mechanism of the developer supply container which can make a significant contribution to savings in cost and space of the resultant image forming apparatus without using the bearings as in Embodiment 1 and exerting an excessive load on the drive mechanism of the image forming apparatus main assembly 100 by only employing the mounting control member 400*c* having inexpensive and simple structure.

(Embodiment 3)

Figure 24:
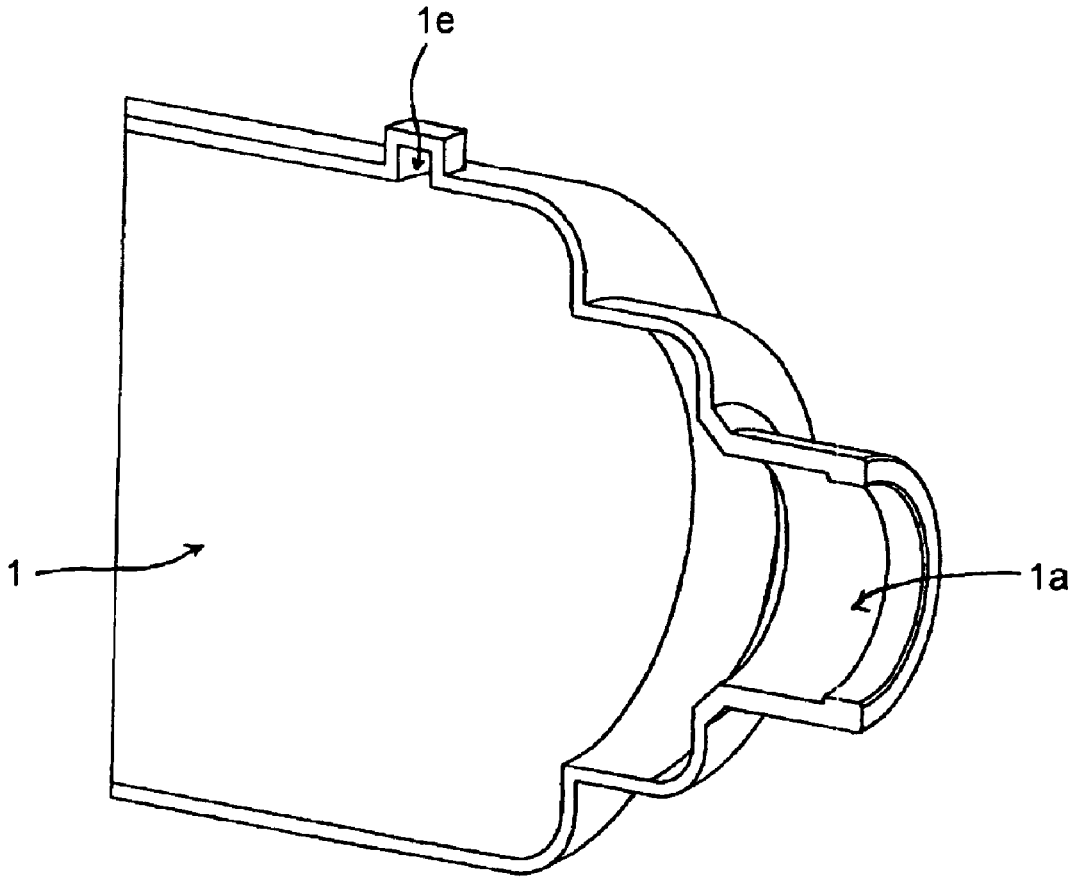
FIG. 24 is a partly broken perspective view of a developer supply container according to a third embodiment of the present invention.

A third embodiment according to the present invention will be described with reference to FIG. 24. Repetitive description on members and functions identical to those in Embodiments 1 and 2 will be omitted. FIG. 24 is a partially broken perspective view showing a developer supply apparatus 1 of this (third) embodiment. In this embodiment, a mounting control projection 1*e* provided to the developer supply container 1 has an inner recessed space which communicates with a developer accommodating portion.

By employing such a structure, the developer can also be accommodated into the mounting control projection 1*e*, so that it becomes possible to increase space saving efficiency. Further, compared with the case of no inner recessed space provided in the mounting control projection 1*e*, a larger inner volume of the developer supply container 1 can be ensured, and constraints on molding of the developer supply container 1 are also circumvented, so that it is possible to make the mounting control projection 1*e* sufficiently large to permit the user to readily recognize the presence of the mounting control portion, thus resulting in improvement in operability. Further, by making the mounting control portion large, the non-interchangeability can be further ensured to improve reliability.

As described hereinabove, according to the respective embodiments of the present invention, mounting and demounting of the developer supply container can be easily performed with reliability only by employing a simple structure.

While the invention has been described with reference to the structures disclosed herein, it is not confined to the details set forth and this application is intended to cover such modifications or changes as may come within the purposes of the improvements or the scope of the following claims.

What is claimed is:

1. A developer supply container detachably mountable to a developer supply apparatus, comprising:

a container body, for accommodating developer, including a discharge opening for permitting discharge of the developer therefrom, coupling means, disposed connectable to a coupling member of the developer supply apparatus, for rotating said container body, feeding means for feeding the developer toward the discharge opening in the container body by the rotation of said container body, and regulation means, disposed at a peripheral surface of said container body, for regulating mounting of said developer supply container on the basis of whether or not it is substantially fitted with a regulation member of the developer supply apparatus, wherein after said developer supply container is set to the developer supply apparatus, said regulation means is capable of rotating the regulation member of the developer supply apparatus by a rotational force received by said coupling means while retaining engagement of said regulation means with the regulation member.

2. A container according to claim 1, wherein after said developer supply container is set to the developer supply apparatus, said regulation means retains its engagement with the regulation member until its demounting operation from the developer supply apparatus is carried out.

3. A container according to claim 1, wherein said regulation means is disposed on a trailing end side of said container body with respect to its mounting direction.

4. A container according to claim 3, wherein said regulation means is engageable with the regulation member which is formed in a ring shape through which said developer supply container is capable of passing.

5. A container according to claim 4, wherein said regulation means has a projection portion engageable with a recess portion provided to the regulation member.

* * * * *

UNITED STATES PATENT AND TRADEMARK OFFICE

CERTIFICATE OF CORRECTION

PATENT NO. : 6,947,690 B2
APPLICATION NO. : 10/682021
DATED : September 20, 2005
INVENTOR(S) : Fumio Tazawa et al.

It is certified that error appears in the above-identified patent and that said Letters Patent is hereby corrected as shown below:

ON THE COVER PAGE:

UNDER REFERENCES CITED, (ITEM 56):

"5,975,286 A 11/1999 Oliff" should read --5,975,286 10/1999 Ban et al.--.

COLUMN 2:

Line 39, "is" should read --in--.

COLUMN 3:

Line 26, "state" should read --a state--;
Line 65, "FIG. 12(b)" should read --FIG. 16(b)--; and "FIG." should read --and FIG.--; and
Line 66, "12(c)" should read --16(c)--.

COLUMN 4:

Line 5, "FIG." should read --and FIG.--.

COLUMN 6:

Line 8, "ar" should read --are--;
Line 28, "method for developer supply container." should read --Method for Developer Supply Container.--; and
Line 32, "FIG. 7 is" should read --FIGS. 7(a) and 7(b) are--.

UNITED STATES PATENT AND TRADEMARK OFFICE

CERTIFICATE OF CORRECTION

PATENT NO. : 6,947,690 B2
APPLICATION NO. : 10/682021
DATED : September 20, 2005
INVENTOR(S) : Fumio Tazawa et al.

It is certified that error appears in the above-identified patent and that said Letters Patent is hereby corrected as shown below:

COLUMN 8:

Line 49, “extended” should read --extends--.

COLUMN 9:

Line 42, “deformable” should read --deform--;
Line 44, “100 of” should read --100 of the--; and
Line 52, “100 of” should read --100 of the--.

COLUMN 10:

Line 22, “disengage” should read --disengaging--; and
Line 65, “is” should read --has--.

COLUMN 11:

Line 19, “an arrow” should read --an--.

COLUMN 12:

Line 19, “its” should be deleted; and
Line 66, “shape shape” should read --shape--.

COLUMN 13:

Line 50, “close” should read --closes--; and
Line 59, “he” should read --the--.

UNITED STATES PATENT AND TRADEMARK OFFICE

CERTIFICATE OF CORRECTION

PATENT NO. : 6,947,690 B2
APPLICATION NO. : 10/682021
DATED : September 20, 2005
INVENTOR(S) : Fumio Tazawa et al.

It is certified that error appears in the above-identified patent and that said Letters Patent is hereby corrected as shown below:

COLUMN 14:

Line 15, "as the" should read --as to--.

COLUMN 15:

Line 11, "According," should read --Accordingly,--; and
Line 20, "form" should read --from--.

COLUMN 18:

Line 6, "FIG. 22" should read --FIGS. 22(a), 22(b), 22(c), and 22(d)--;
Line 7, "is" should read --are--; and
Line 12, "FIG. 23 is" should read --FIGS. 23(a) and 23(b) are--.

COLUMN 19:

Line 3, "lager" should read --larger--.

Signed and Sealed this

Eighteenth Day of July, 2006

JON W. DUDAS
*Director of the United States Patent and Trademark Office*